US006282858B1

(12) United States Patent
Swick

(10) Patent No.: US 6,282,858 B1
(45) Date of Patent: Sep. 4, 2001

(54) ROOFING PANEL SYSTEM AND METHOD FOR MAKING SAME

(75) Inventor: Andrew C. Swick, 576 Cross Creek Ter., Crystal Lake, IL (US) 60014

(73) Assignee: Andrew C. Swick, Crystal Lake, IL (US)

( * ) Notice: Subject to any disclaimer, the term of this patent is extended or adjusted under 35 U.S.C. 154(b) by 2 days.

(21) Appl. No.: 09/516,443

(22) Filed: Feb. 29, 2000

Related U.S. Application Data

(60) Provisional application No. 60/121,938, filed on Mar. 4, 1999.

(51) Int. Cl.[7] ..... E04D 1/08; E04D 1/20

(52) U.S. Cl. ..... 52/533; 52/302.1; 52/520; 52/526; 52/547; 52/555; 52/591.5

(58) Field of Search ..... 52/198, 302.1, 52/510, 519, 520, 526, 533, 547, 555, 591.4, 591.5

(56) References Cited

U.S. PATENT DOCUMENTS

| | | | | |
|---|---|---|---|---|
| 2,766,706 | * | 10/1956 | Ludowici | 52/533 |
| 3,264,790 | * | 8/1966 | Beals | 52/14 |
| 3,579,940 | | 5/1971 | Greenleaf . | |
| 3,775,925 | | 12/1973 | Fujita . | |
| 3,785,114 | * | 1/1974 | Kough et al. | 52/748.1 |
| 3,848,383 | * | 11/1974 | Wilson et al. | 52/533 |
| 3,852,934 | | 12/1974 | Kirkhuff . | |
| 3,875,715 | | 4/1975 | Martin et al. . | |
| 3,943,677 | | 3/1976 | Carothers . | |
| 4,028,450 | | 6/1977 | Gould . | |
| 4,279,106 | | 7/1981 | Gleason et al. . | |
| 4,343,126 | | 8/1982 | Hoofe . | |
| 4,406,106 | | 9/1983 | Dinges . | |
| 4,432,183 | * | 2/1984 | Pike et al. | 52/533 |
| 4,514,947 | | 5/1985 | Grail . | |
| 4,759,165 | | 7/1988 | Getoor et al. . | |
| 4,777,776 | | 10/1988 | Morrell . | |
| 4,856,236 | | 8/1989 | Parker . | |
| 4,932,184 | | 6/1990 | Waller . | |
| 4,949,522 | | 8/1990 | Harada . | |
| 5,048,255 | | 9/1991 | Gonzales . | |
| 5,060,444 | * | 10/1991 | Paquette | 52/535 |
| 5,277,011 | * | 1/1994 | Serrrano Martin | 52/533 X |
| 5,635,125 | | 6/1997 | Ternes . | |
| 5,711,126 | | 1/1998 | Wells . | |

* cited by examiner

*Primary Examiner*—Beth A. Stephan
*Assistant Examiner*—Brian E. Glessner

(57) ABSTRACT

An injection molded rigid roof panel system for constructing pitched roof structures of the type affixed directly to roof trusses or rafters and needing no structural or supporting sheathing surface or moisture barrier. Comprised of no less than (23) standard roof panel components of varying shapes, sizes, colors and exposed surfaces replicating conventional roofing surfaces. Panels overlap, underlap and interlock by means of an array of shoulders, locating ribs and clearance channels creating a unitized roof system utilizing integral seals at the seams, subsurface water channels and self sealing, threaded fasteners whose molded-in, counter-bored holes are further sealed by composite plugs. Panels are produced by mixing, extruding and pelletizing a compound of over 60% recycled materials and encapsulating a semi-rigid fiberglass mesh sheet in the panels during the injection molding process producing a roofing product that is fire retardant, impervious to moisture, insects, ultraviolet rays and winds in excess of 130 mph.

1 Claim, 40 Drawing Sheets

| LEGEND | |
|---|---|
| "4" | SEE SHT. 4 |
| "12" | SEE SHT. 12 |
| "13" | SEE SHT. 13 |
| "16" | SEE SHT. 16 |
| "17" | SEE SHT. 17 |
| "18" | SEE SHT. 18 |
| "26" | SEE SHT. 26 |
| "28" | SEE SHT. 28 |
| "31" | SEE SHT. 31 |
| "32" | SEE SHT. 32 |
| "33" | SEE SHT. 33 |
| "34" | SEE SHT 34 |

LEGEND
"5" SEE SHT. 5
"7" SEE SHT. 7
"10" SEE SHT. 10
"11" SEE SHT. 11
"9" SEE SHT. 9

LEGEND
A 2.5° ANGLE
B-B SEE SHT. 6

"6"
"6"
15
18
4
19
7
18
4
3
17
5
33
8
1
33
A

"23"
26
15
16
3
18
"5"
14
1
2
"25"
27
8
5
33
"10"
24

2
25
11
1
8
33

LEGEND
"5" SEE SHT. 5
"10" SEE SHT. 10
"23" SEE SHT. 23
"25" SEE SHT. 25

LEGEND
"21" SEE SHT. 21
"22" SEE SHT. 22
"23" SEE SHT. 23
"24" SEE SHT. 24

LEGEND
"7" SEE SHT. 7
"14" SEE SHT. 14
"19" SEE SHT. 19
"20" SEE SHT 20

| LEGEND | |
|---|---|
| "7" | SEE SHT. 7 |
| "19" | SEE SHT. 19 |
| "21" | SEE SHT. 21 |
| "22" | SEE SHT. 22 |

14
15
33
28
29
30
1
50
31

29
28
33
50
30

"27"
35
15
37
1
34
14
36
38
LEGEND
"27" SEE SHT. 27

| LEGEND | |
|---|---|
| "29" | SEE SHT. 29 |
| "30" | SEE SHT. 30 |

37
1
36
15
38
39
15
37
38
36

37
38
36
1
15
36
38

35
37
15
14
1
34
35
1

15
37
14
1
35

34
1
36
38
1
36

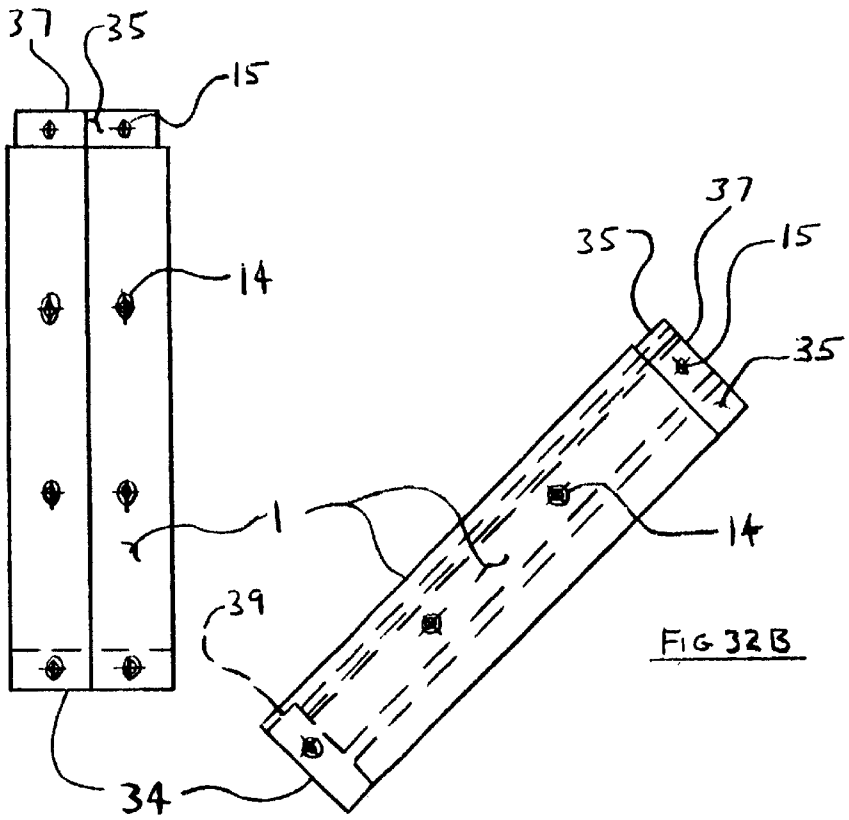
FIG. 32A
FIG. 32B
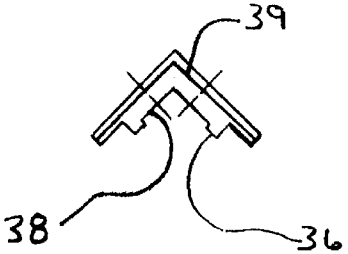
FIG. 32C 2
14
28
29
18
15
3
"5"
1
8
5
33
"10"
25
9

25
1
11
33
LEGEND
"5" SEE SHT. 5
"10" SEE SHT. 10

LEGEND
"21" SEE SHT. 21
"22" SEE SHT. 22

| LEGEND | |
|---|---|
| "4" | SEE SHT. 4 |
| "39" | SEE SHT. 39 |

ROOFING PANEL SYSTEM AND METHOD FOR MAKING SAME

CROSS-REFERENCE TO RELATED APPLICATIONS

This application claims benefit of Provisional No. 60/121,938 filed Mar. 4, 1999.

BACKGROUND—FIELD OF INVENTION

This invention relates generally to rigid roof panels as they apply to "pitched" roofs. More specifically, to the design, manufacture and installation methodologies of a roof panel system intended for use on roof construction with a minimum pitch of 3:12. This invention is an injection molded, fiberglass reinforced thermoplastic compound roof panel system that is designed to be installed directly onto the subject building's roof trusses or rafters in a sealed, interlocking, overlapping and self-draining manner.

BACKGROUND—DESCRIPTION OF PRIOR ART

In the past, roof and roof panel construction generally required a plywood or similar sheathing surface as a means of structurally/mechanically attaching the components to the building structure. Specific references can be made to a plurality of common roofing media.

These include asphalt or fiberglass shingles of the type disclosed in U.S. Pat. No. 3,903,340 and wood shingles such as cedar shakes, slate, clay, cementious and plastic/composite tiles of the types disclosed in U.S. Pat. Nos. 5,711,126; 5,635,125; 4,949,522; 4,514,947; 3,852,934 and 3,579,940. There are numerous types of metal panel systems such as disclosed in U.S. Pat. Nos. 4,759,165 and 4,406,106 as well. Each of these roof types requires that one or more waterproof membranes (e.g., tar paper) be installed over the sheathing surface before the roof covering media is installed.

Additional references herein are made to a plurality of roof panel systems manufactured with composite materials as well as prefabricated panel systems that integrate the plywood or rigid laminate sheathing into the assembly of the roof panel.

Each of the individual roofing media types has distinct advantages and disadvantages. Some of these are performance and some appearance related. For instance, cedar shakes look attractive but have problems such as flammability, moisture retention, mold and rot. Wood shakes will dry out over time in dry/sunny conditions and split, warp or crack. Insects can infest the shakes by boroughing into the body of the shake and weakening it there by reducing the useful lifespan of the product. Slate, clay and cement tiles solve these problems but require a relatively high level of maintenance to keep them secured, they are brittle and crack easily when walked on and require heavier sheathing to support their relatively high weight per square (100 sq.ft.). Slate, clay and cement tiles are prohibitively costly to purchase and install for average size/cost structures.

There is a plurality of composite products currently on the market that simulate wood shakes, slate and clay tiles as well as conventional shingles but these products generally offer minimal cost or performance advantages over the products they are meant to replace. As a result, little incentive for using these products is realized.

In all of the prior art, however, a rigid sheathing material is required whether it is applied prior to the roof media or in conjunction with a prefabricated panel. The rigid sheathing is required to structurally secure the roof trusses or rafters together and support roof loads as well as provide a continuous rigid surface for attaching the loose roof covering components.

The majority of the prior art is secured to the roof structure by means of nails or staples and oft times requires additional wood strips be secured horizontally to build up the top edge of the roof components. Virtually all of the prior art is installed in a systematic manner that requires the installer to begin at a lower corner of the roof structure and proceed in a horizontal left-to-right or right-to-left fashion until the first coarse is complete. Only after the first course is complete can the second coarse be started. Each subsequent coarse is completed in such a same manner by overlapping the previous coarse. Roofs of this type are secured to the structure with the nails or staples being applied by hand or via use of pneumatic nail or staple guns.

The entire process of completing the roof structure beginning at the roof trusses or rafters requires several days of labor with specially trained workers for each phase of the job. Typically, carpenters will apply the sheathing to the trusses and a roofing contractor will then apply the felt paper and roofing media. Some of the specialty type media such as slate and the various tiles require further specialized installers and are cost prohibitive for wide spread use on median market homes and buildings.

Of the prior art sited herein, only one, U.S. Pat. No. 5,635,125, addresses the issue of recyclability. Historically the scrap generated at construction sites constitutes a large percentage of landfilled waste. Conventional roofing media is difficult to collect, segregate and recycle. Each step in the construction of the roof structure generates its own type of scrap or waste which is either burned or simply hauled away in a dumpster, adding to the already overwhelming environmental burdens placed on existing landfills.

A search of the prior art did not disclose any patents that read directly on the claims of the instant invention, however, the following U.S. patents were considered related:

| U.S. Pat. No. | Inventor(s) | Filing Date |
|---|---|---|
| 5048255 | Gonzales | 2/12/90 |
| 4932184 | Waller | 3/6/89 |
| 4856236 | Parker | 8/15/89 |
| 4777776 | Morrell | 4/26/82 |
| 4759165 | Getoor; Pottinger | 5/30/86 |
| 4406106 | Dinges | 4/13/81 |
| 4343126 | Hoofe | 11/14/80 |
| 4279106 | Gleason; Greenleaf | 11/5/79 |
| 4028450 | Gould | 4/19/74 |
| 3943677 | Carothers, et. al. | 8/5/74 |
| 3875715 | Martin, et. al. | 6/21/73 |
| 3775925 | Keiich | 12/4/73 |

SUMMARY OF THE INVENTION—OBJECTS AND ADVANTAGES

It is the object of the present invention to provide a rigid roof construction for pitched roofs by systematically positioning a plurality of differing standard roof panel shapes, sizes and configurations directly over the roof trusses or rafters, eliminating the need for plywood or other sheathing and secondary moisture barriers. The plurality of panels are installed sequentially in a manner that provides for overlapping, underlapping and interlocking seams that include an integral seal and channels for shedding water.

A primary object of the invention is that each panel configuration incorporates a unique water channeling system that lies beneath the exposed surface of the panels at each seam. Moisture that is driven between adjoining panels by strong winds is shed from the roof structure by means of the integral water channels that are located on the horizontal head-lap and one end of each panel. Each panel has an integral seal located on the shoulder adjacent to an outboard of the upward facing water channel.

An additional object of the invention is that when positioned in the proper sequence, the downward facing shoulder compresses the seal thereby creating a double edge seal on both underlapping and overlapping panels. The shapes and sizes of the upward facing water channels and the corresponding downward facing shoulders is such that a simple and accurate method of location is realized.

Another primary objects of the invention is that the panels will be secured in place with threaded, self-sealing fasteners. The fastener holes are located on a plane above the water channels and inboard of the seals. This method of installation provides a continuous, rigid roof surface, which seals out wind driven moisture, efficiently drains moisture off of the roof structure and is effective in withstanding high winds that would normally damage or destroy more conventionally installed roof structures.

Another object of the current invention is to provide a rigid roof panel system that by means of the design and method of manufacture, a fiberglass mesh sheet is encapsulated during the molding process there by adding strength and stiffness to the body of each panel. A significant object of the present invention is that the encapsulated fiberglass mesh sheet provides for a Class A fire barrier when tested according to ASTM test E108-93 ANSI/UL 790 for flame spread, burning brand and intermittent flame requires less time and relatively unskilled labor to complete the installation from the trusses or rafters up, thereby reducing the cost of roof construction and limiting the length of time the structure is exposed to the elements.

The present invention further provides a process of manufacture of the panels, which includes mixing and extruding a compound of virgin and ground-up recycled thermoplastic particles, shredded printed circuit board resin, reground tire rubber and a plurality of additives for improving the physical and thermal properties of the finished product. The process is continued by inserting a cut and formed fiberglass sheet into the mold and encapsulating it during the molding process. This is followed by the insertion of the extruded foam seal to complete the process. Each step of the process can utilize commonly available equipment with minor customization.

A further object of the invention is to provide a rigid roof panel system which can replicate the exposed ornamental surface textures and colors of the most common roof covering media currently in use such as wood shakes, Spanish, French and slate tiles, conventional shingles and standing-rib metal panels.

Additional objects and features will appear from the following description in which the preferred embodiments have been set forth in detail in conjunction with the accompanying drawings.

DESCRIPTION OF THE DRAWINGS

In the drawings, closely related figures or portions thereof have the same numerals to identify like features but different numbers and alphabetic suffixes to identify the specific figures. Unless specified otherwise, all figures depicting the plurality of panels are shown with a plain, flat upper surface for simplicity sake.

FIGS. 32A–32C, Sheet 32—show a plan view of a Standard Hip and Ridge Saddle Panel.

REFERENCE NUMERALS IN DRAWINGS

Figure 1A:
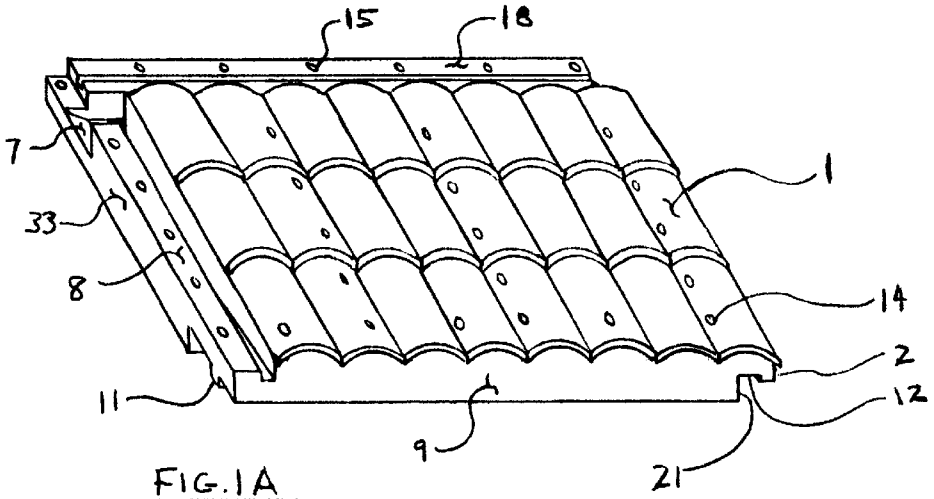
FIGS. 1A & 1B, Sheet 1—shows perspective views of a Standard Field Panel with simulated Spanish Tile and Cedar Shake surfaces.

1 Top (exposed) surface of all panel components
2 Trailing edge of all panel components
3 Upward facing surface of horizontal water channel
4 Horizontal seal channel
5 Upward facing surface of lateral (end) water channel
6 Horizontal water channel flap
7 Horizontal water channel return
8 Lateral under-lap shoulder
9 Front edge of non-starter panels
10 Horizontal over-lap seal compression surface
11 Horizontal over-lap locating rib
12 Lateral over-lap clearance channel
13 Lateral over-lap shoulder transition
14 Counter-bored through hole for fastener
15 Under-lap straight through hole for fastener
16 Optional location for fastener holes
17 Water channel transition
18 Horizontal under-lap shoulder
19 Under-lap interlock feature
20 Lateral interlock feature
21 Lateral over-lap clearance channel wall
22 Lateral over-lap shoulder
23 Underside reinforcing rib walls
24 Lateral water channel transition
25 Horizontal over-lap rear wall
26 End panel lateral upper return wall
27 End panel lateral lower return wall
28 Valley/Hip joint panel diagonal under-lap shoulder
29 Valley/Hip joint panel diagonal seal channel
30 Starter panel front edge
31 Starter panel lateral water channel
32 Valley/Hip joint panel channel return
33 Leading edge of all panel components
34 Valley/Hip/Ridge saddle leading edge
35 Valley/Hip/Ridge saddle under-lap
36 Valley/Hip/Ridge saddle lateral locating rib
37 Valley/Hip/Ridge saddle trailing edge
38 Valley/Hip/Ridge saddle lateral over-lap
39 Valley/Hip/Ridge saddle over-lap
40 Fastener hole plug
41 Extruded foam seal
42 Self sealing fastener
43 Common roof truss/rafter
44 Ridge board
45 Fiberglass mesh sheet
46 Alternate embodiment—Valley Saddle
47 Alternate embodiment—Valley Cap
48 Gable fascia
49 Alternate embodiment—Gable End Cap
50 Starter panel drip flap
51 Blending mixer
52 Extruder/pelletizer
53 Injection molding machine
54 Fiberglass mesh sheet loading robot

DESCRIPTION OF PREFERRED EMBODIMENTS

Figure 1B:
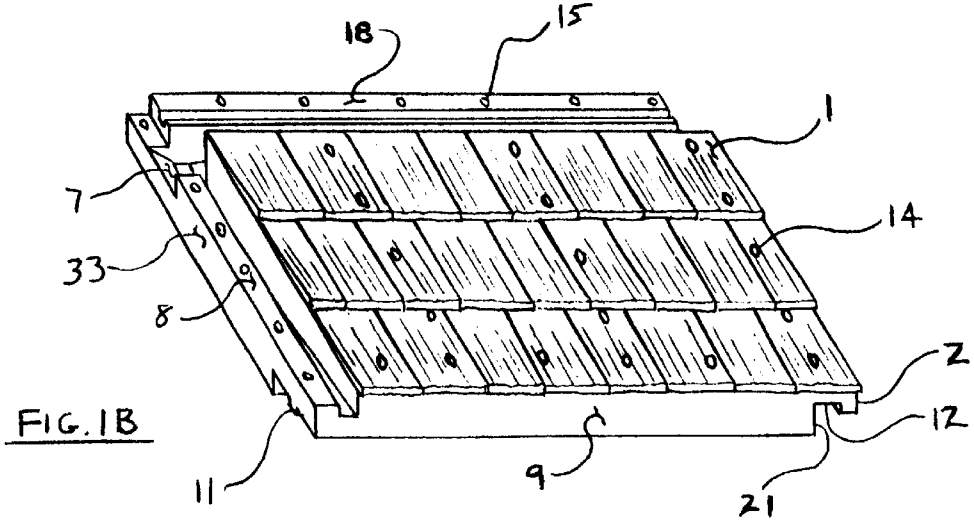
Figure 2:
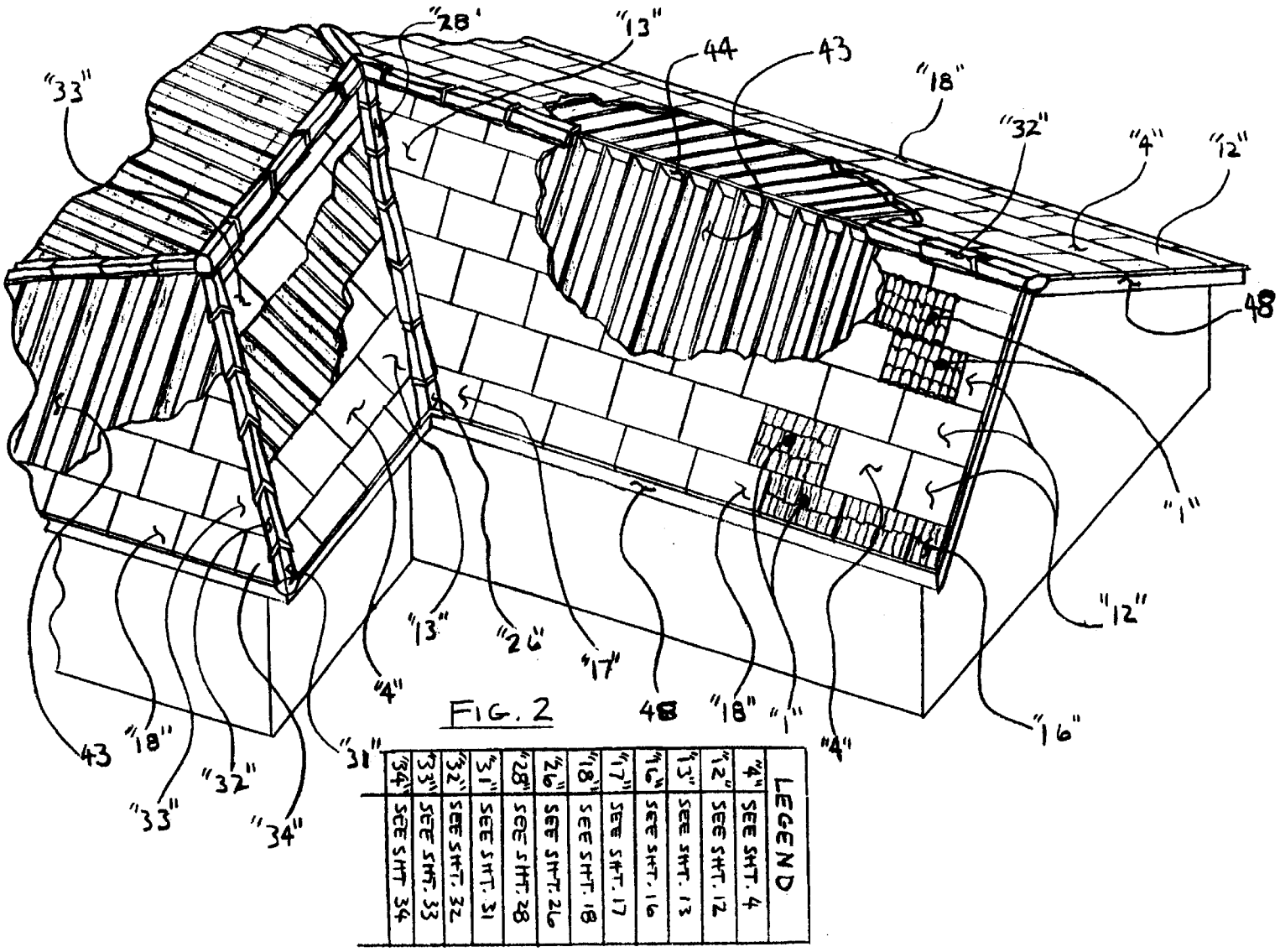
FIG. 2, Sheet 2—shows a partial diagrammatic perspective view of a partially completed building structure incorporating the principals of the present invention.

The desired method for carrying out the invention is presented in terms of a preferred embodiment. The present invention is comprised of no fewer than (23) individual panels designed for specific applications during the installation of the roof structure. FIG. 2 illustrates how the typical embodiment is configured. The current invention is designed to be installed on any roof structure with a minimum pitch of 3:12 wherein for every 12" of run the slope of the roof will rise 3". The current invention is further designed to be installed on any roof structure with a truss or rafter center line to center line distance of 16" or 24" for standard runs but the End Panels can be made to any length between 7" (3"exposed) and 52" (48"exposed) in increments of ½". This is easily accomplished by means of interchangeable tooling details in the molds. In this same manner of interchangeable tooling, a plurality of exposed panel surfaces can be realized as illustrated in FIGS. 1A and 1B.

Figures 16A, 16B, 16C, 16D:
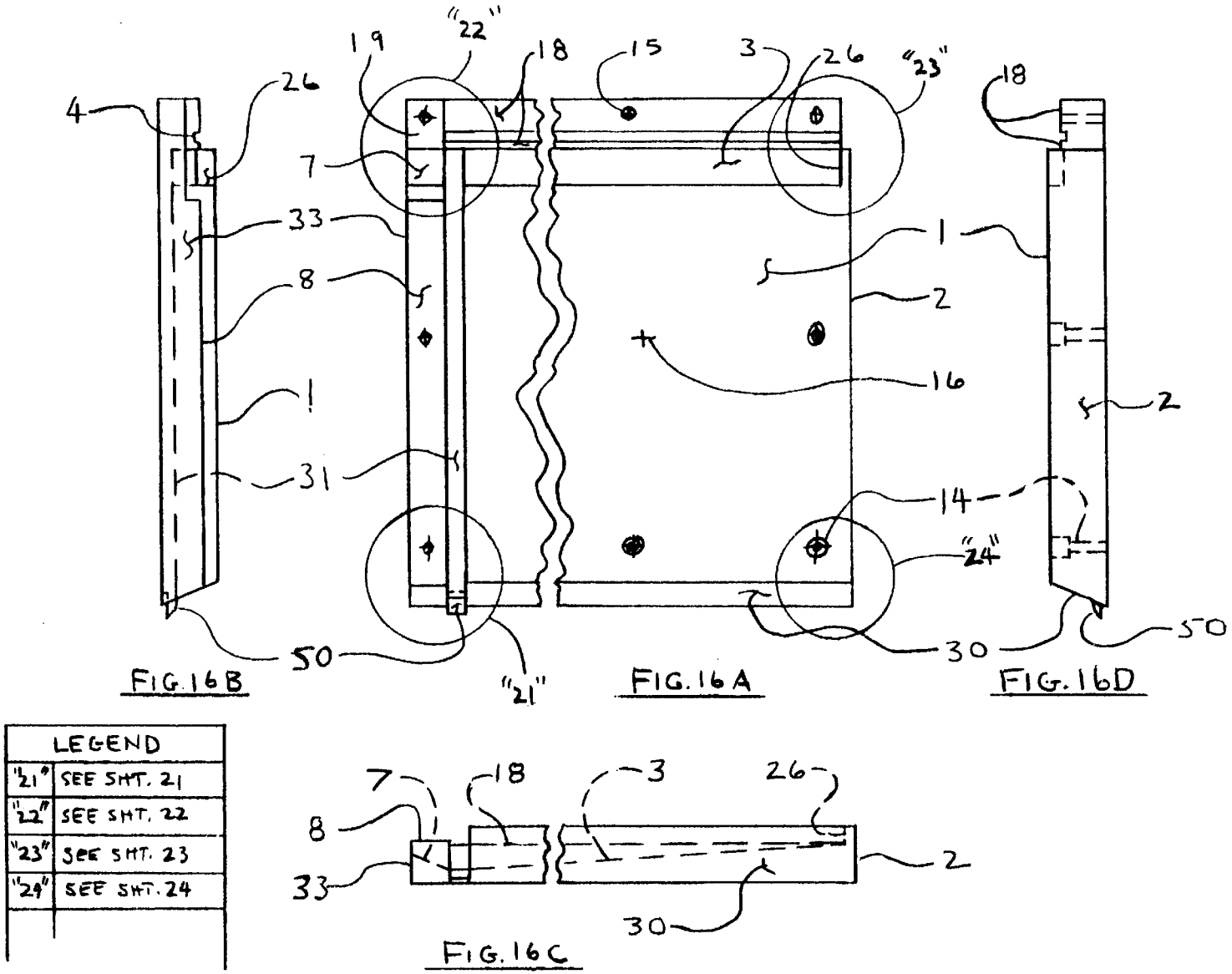
FIGS. 16A–16C, Sheet 16—show a plan view of a right-hand version of a Starter End Panel.
Figures 17A, 17B, 17C, 17D:
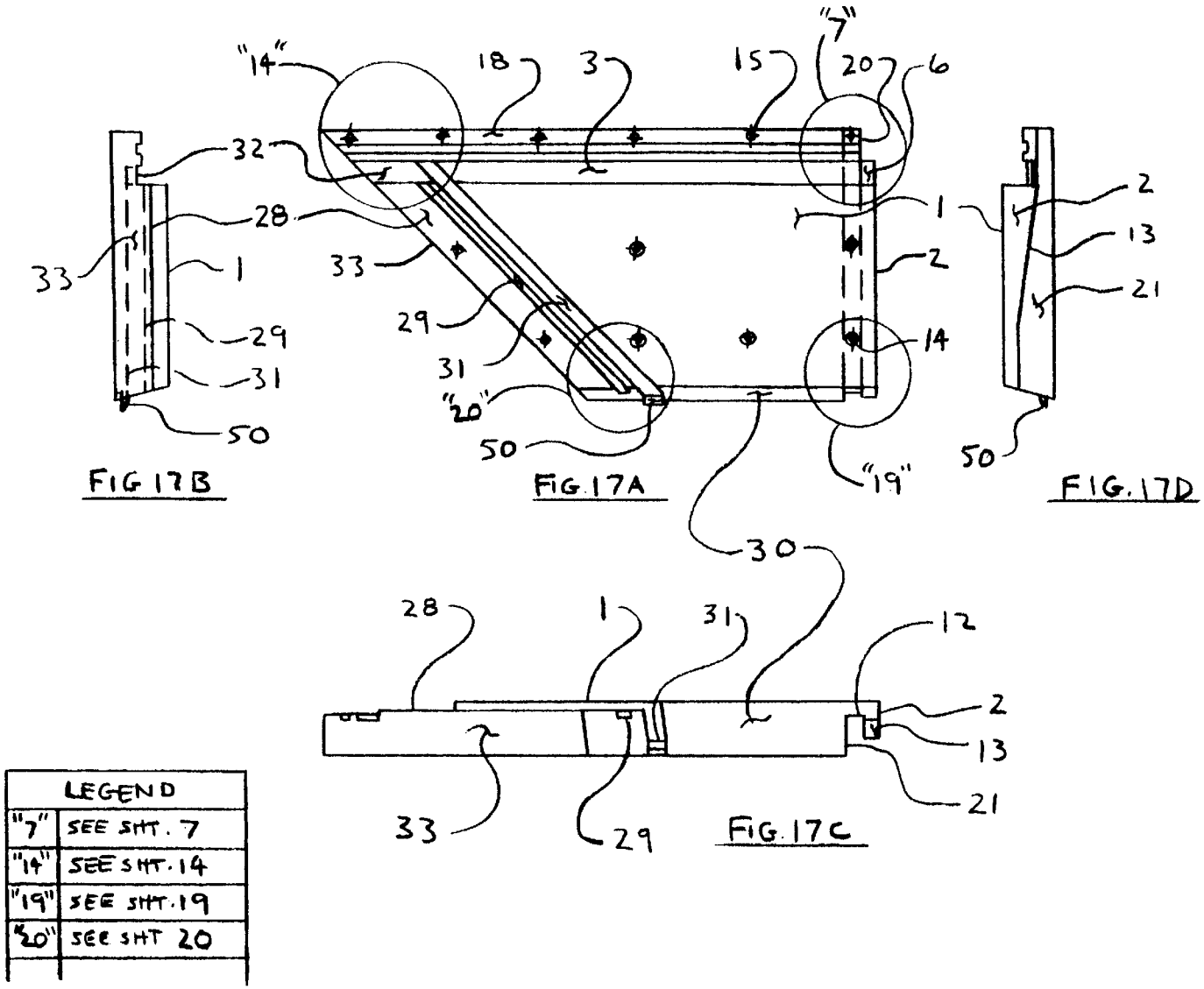
FIGS. 17A–17D, Sheet 17—show a plan view of a right-hand version of a Valley Joint Starter Panel.
Figure 18:
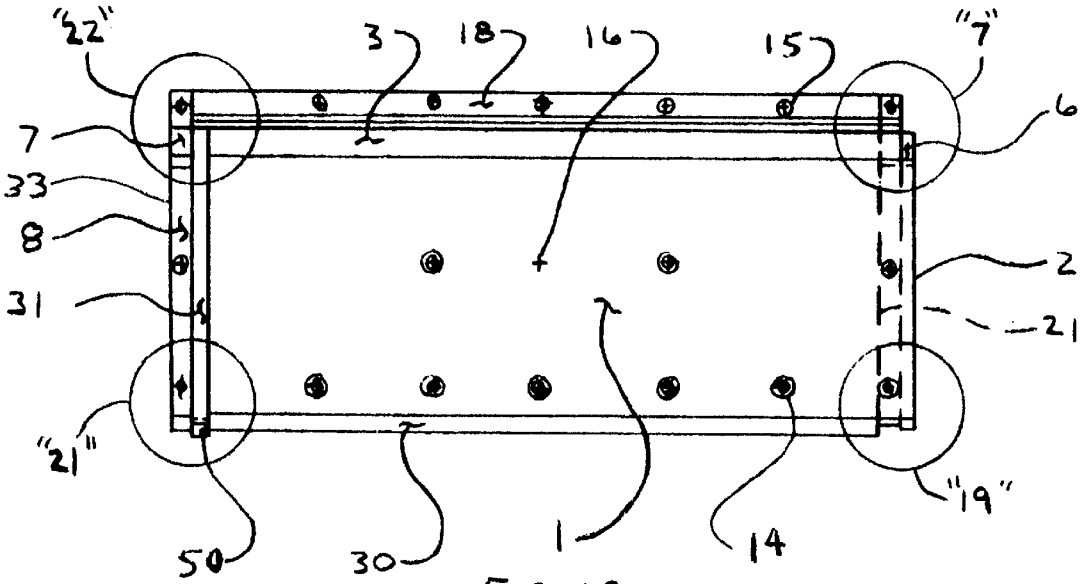
FIG. 18, Sheet 18—shows a top view of a right-hand version of a Standard Starter Panel.
Figures 19A, 19B:
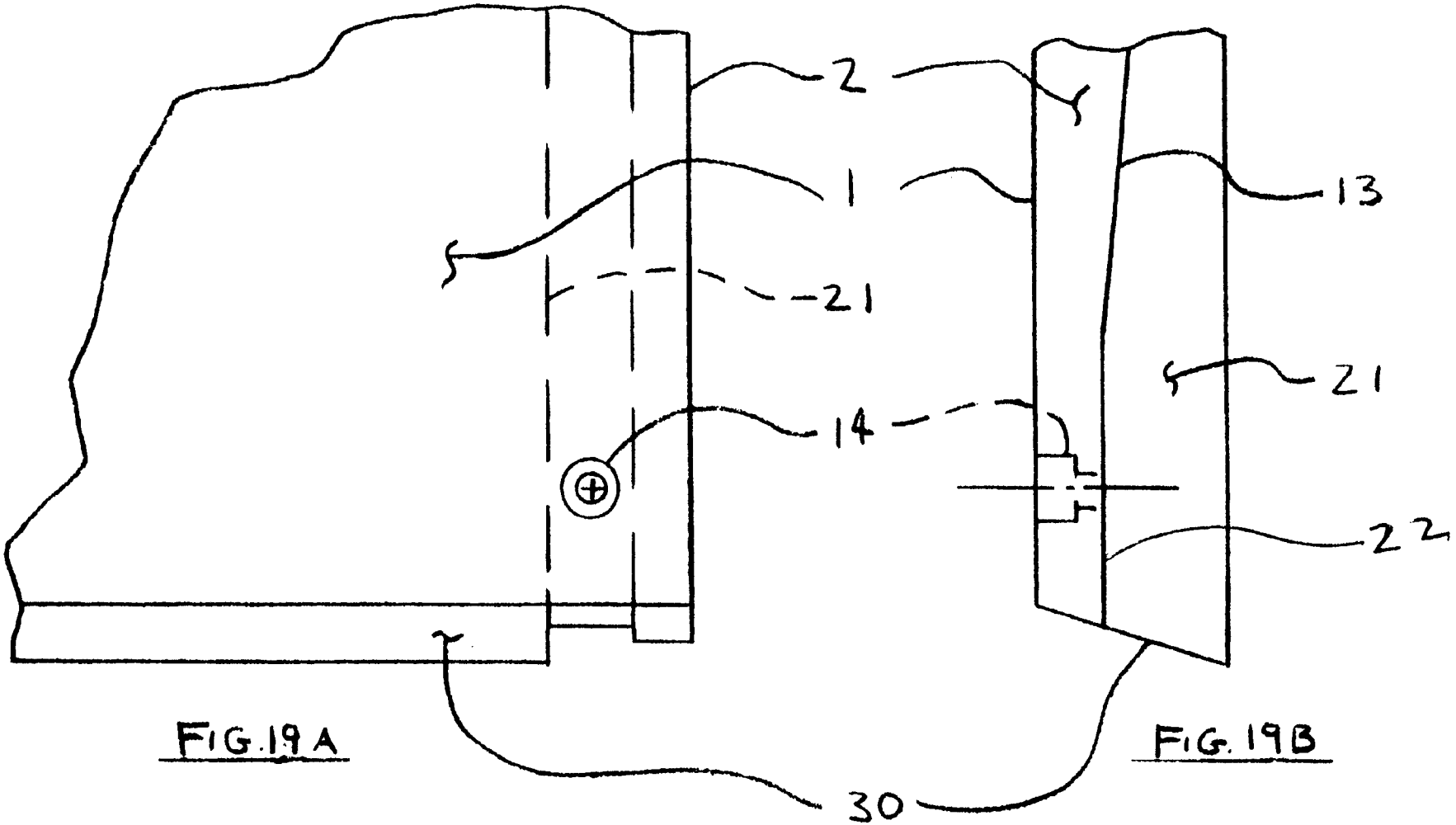
FIGS. 19A & 19B, Sheet 19—show an enlarged, partial plan view of the lower right corner of the panel shown in FIGS. 17A & 18.
Figures 20A, 20B:
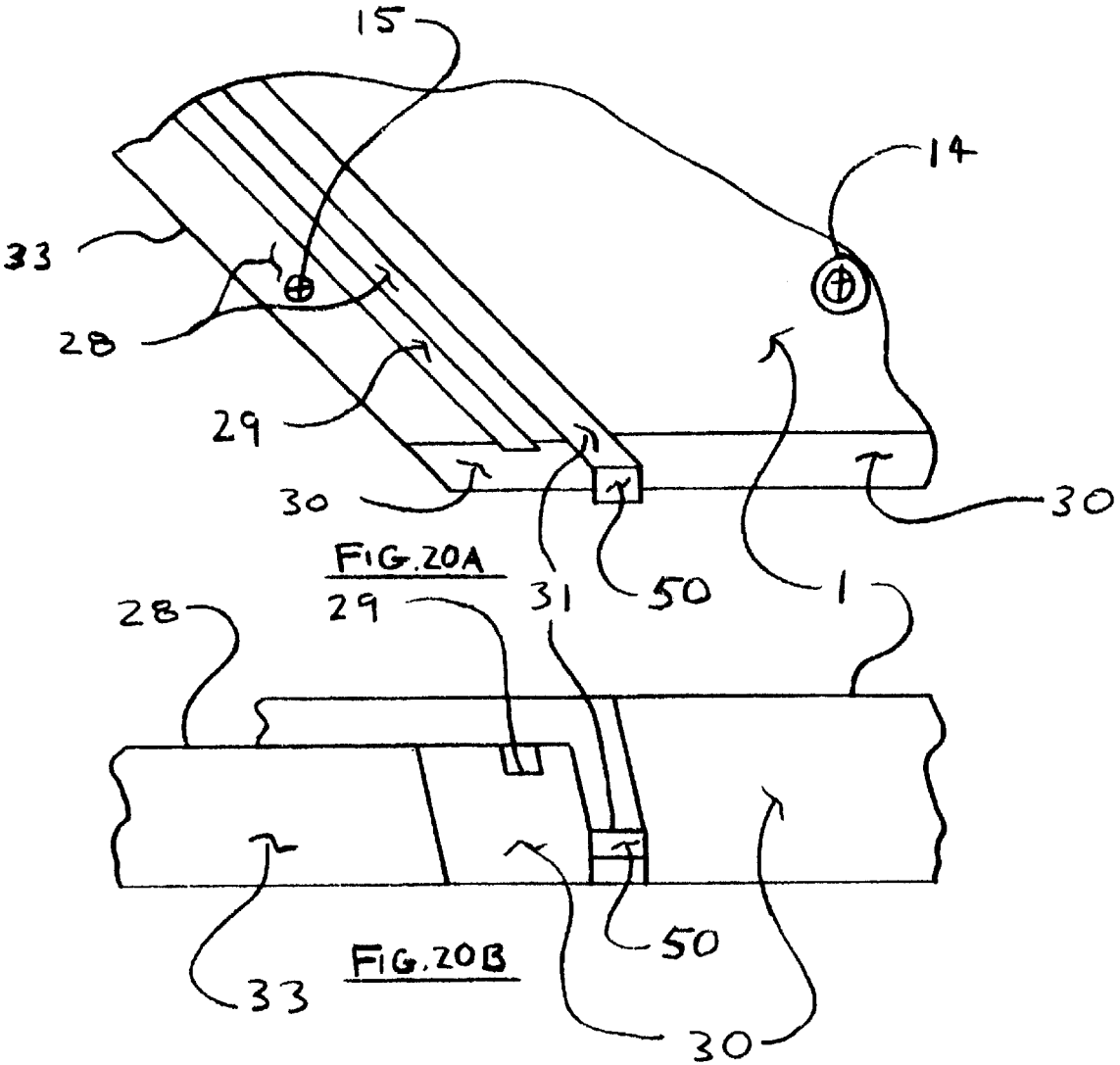
FIGS. 20A & 20B, Sheet 20—show an enlarged, partial plan view of the lower left corner of the panel shown in FIG. 17A.
Figures 21A, 21B, 21C:
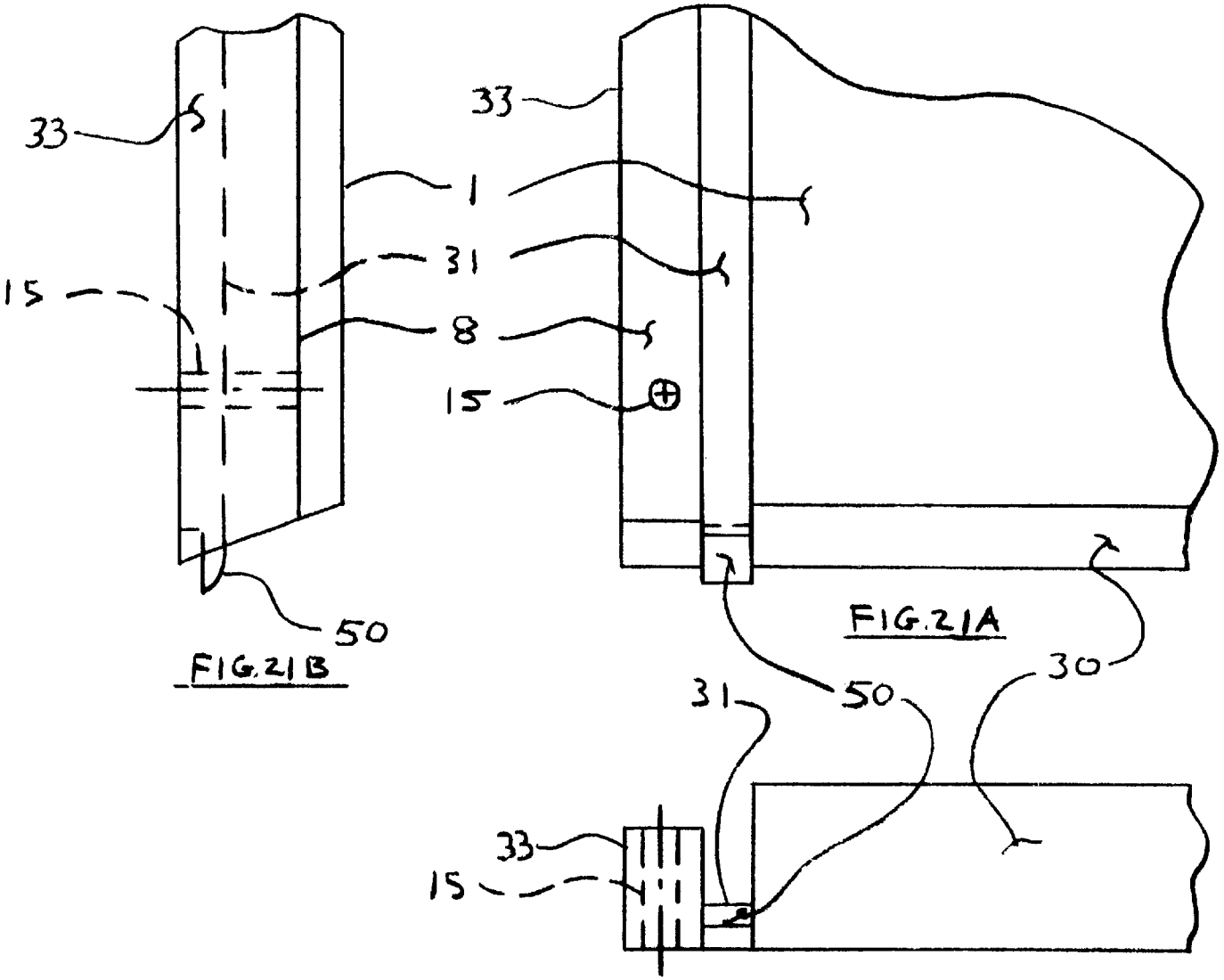
FIGS. 21A–21C, Sheet 21—show an enlarged, partial plan view of the lower left corner of the panel shown in FIGS. 16A, 18 & 34A.
Figure 22A:
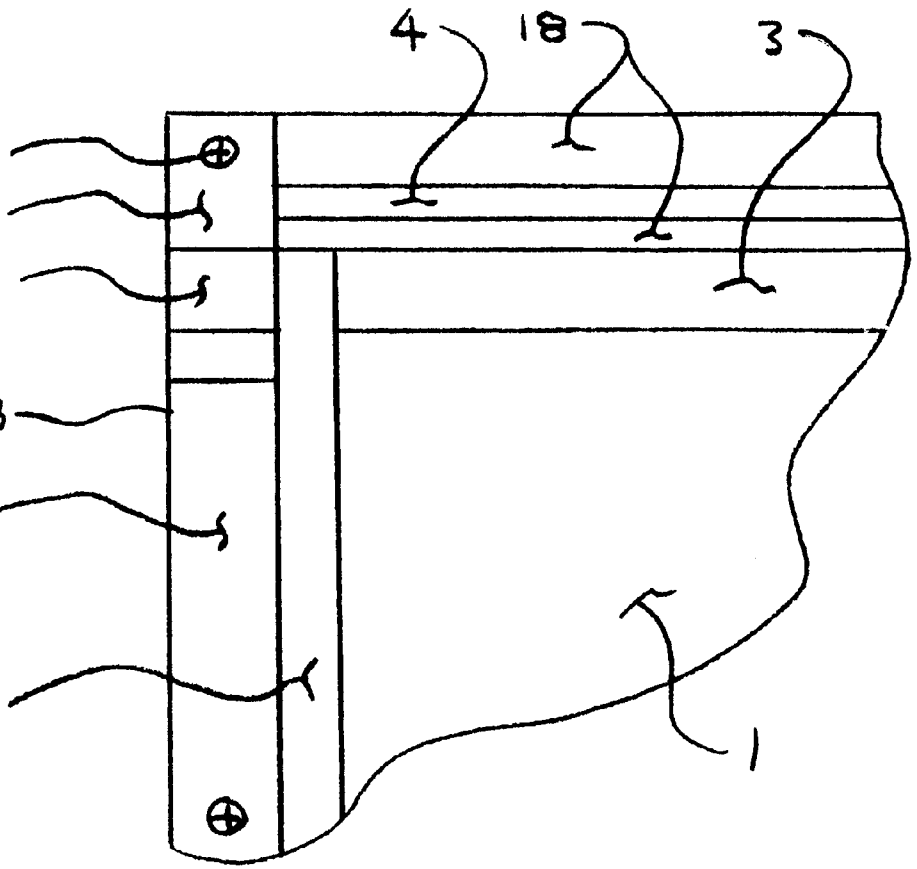
FIGS. 22A & 22B, Sheet 22—show an enlarged, partial plan view of the upper left corner of the panel shown in FIGS. 16A, 18 & 34A.
Figure 22B:
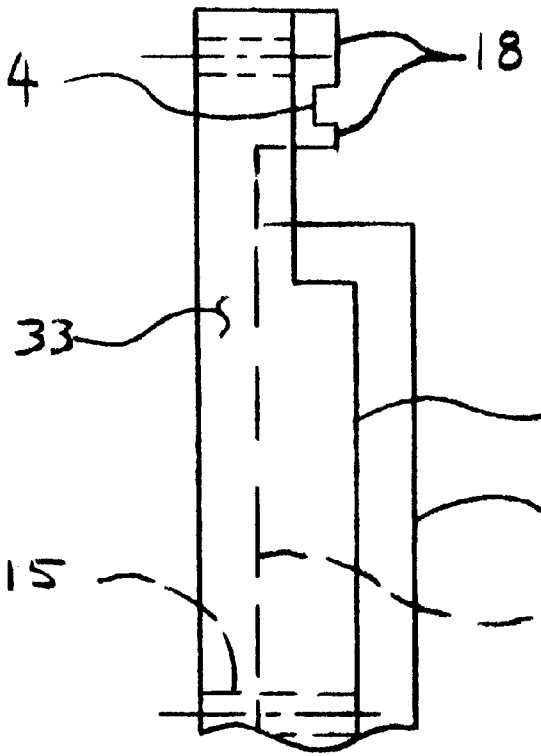
Figure 23B:
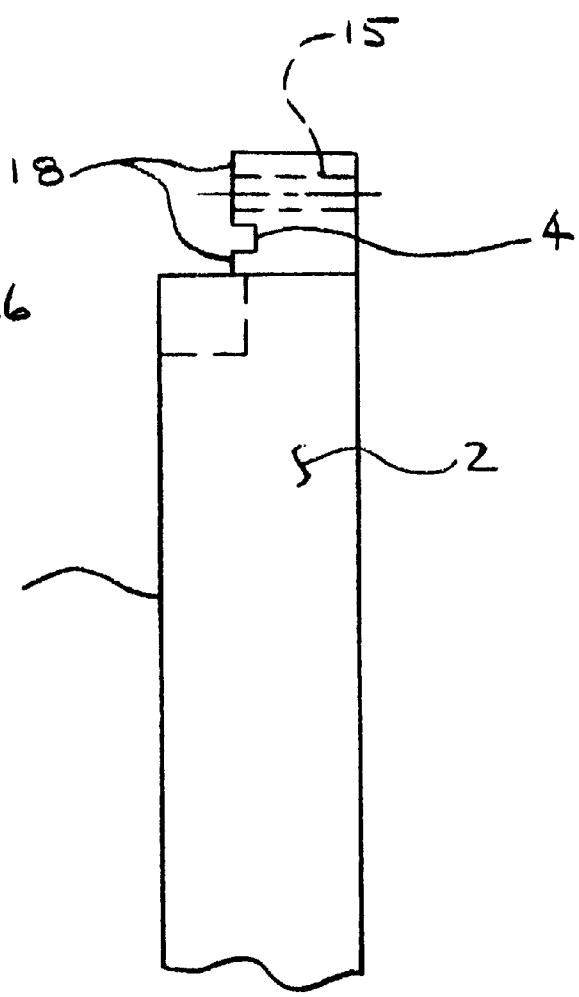
FIGS. 23A & 23B, Sheet 23—show an enlarged, partial plan view of the upper right corner of the panel shown in FIGS. 12A & 16A.
Figure 23A:
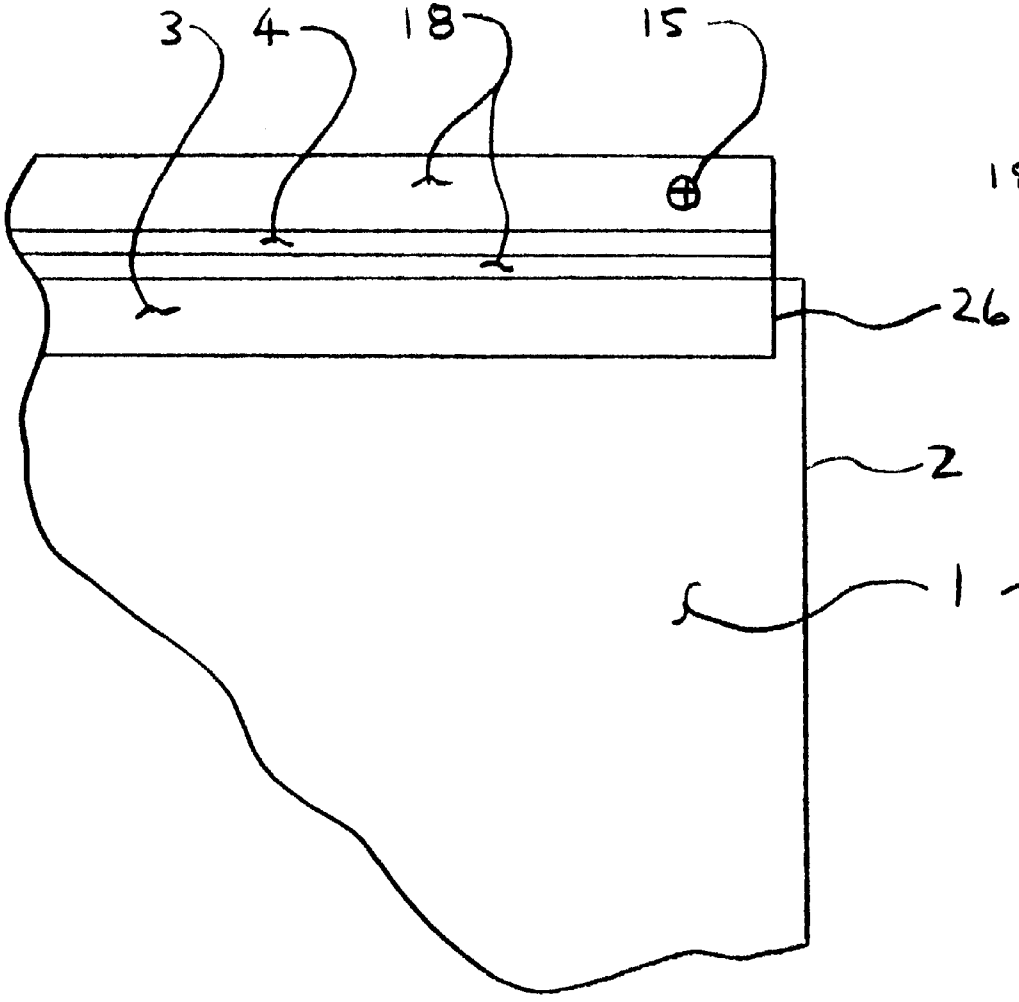
Figures 24A, 24B:
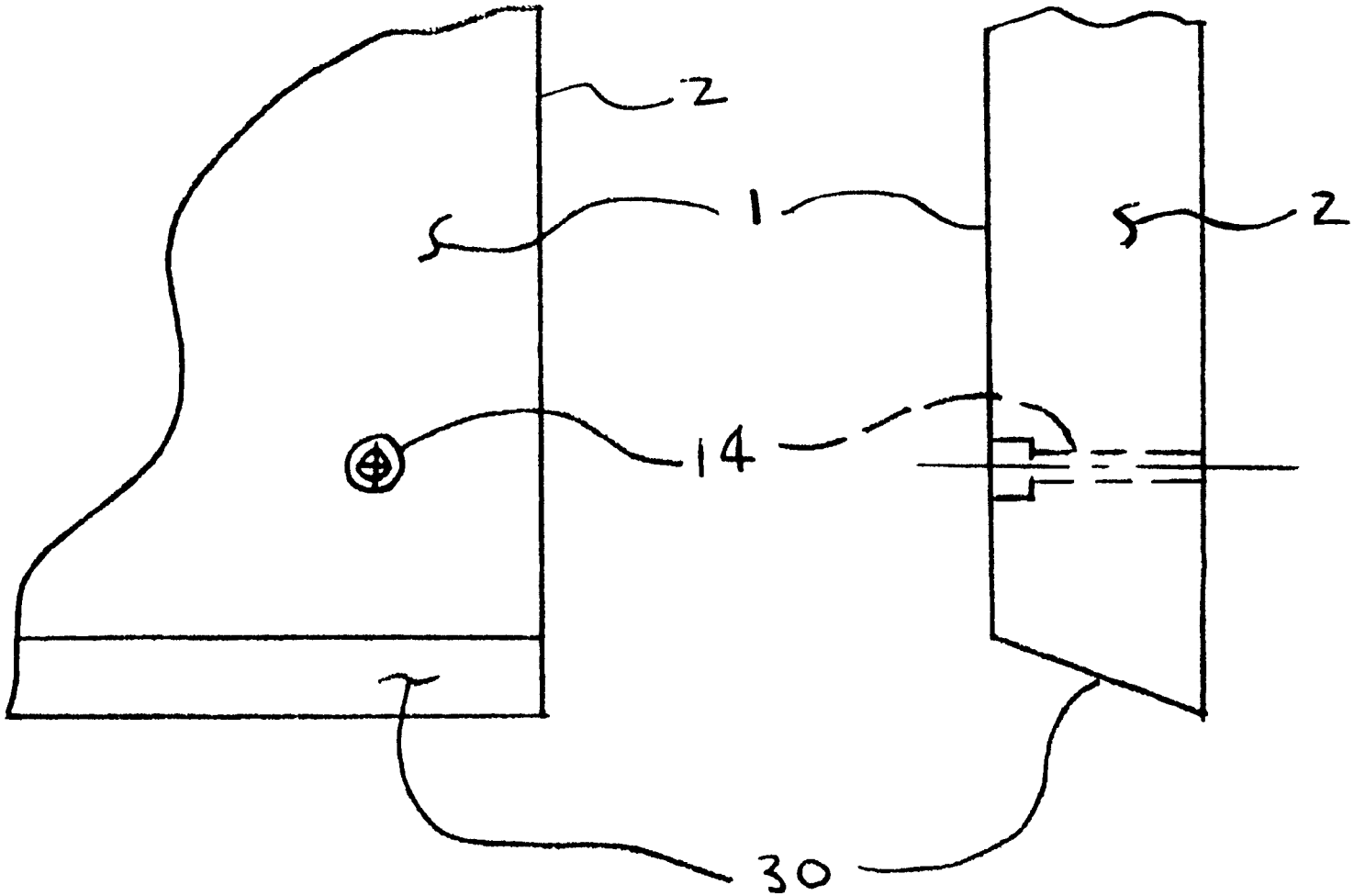
FIGS. 24A & 24B, Sheet 24—show an enlarged, partial plan view of the lower right corner of the panel shown in FIG. 16A.
Figure 25B:
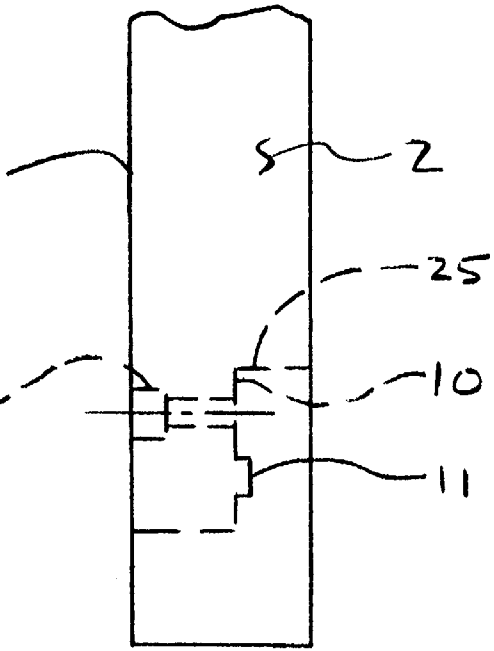
FIGS. 25A–25C, Sheet 25—show an enlarged, partial plan view of the lower right corner of the panel shown in FIG. 12A.
Figure 25A:
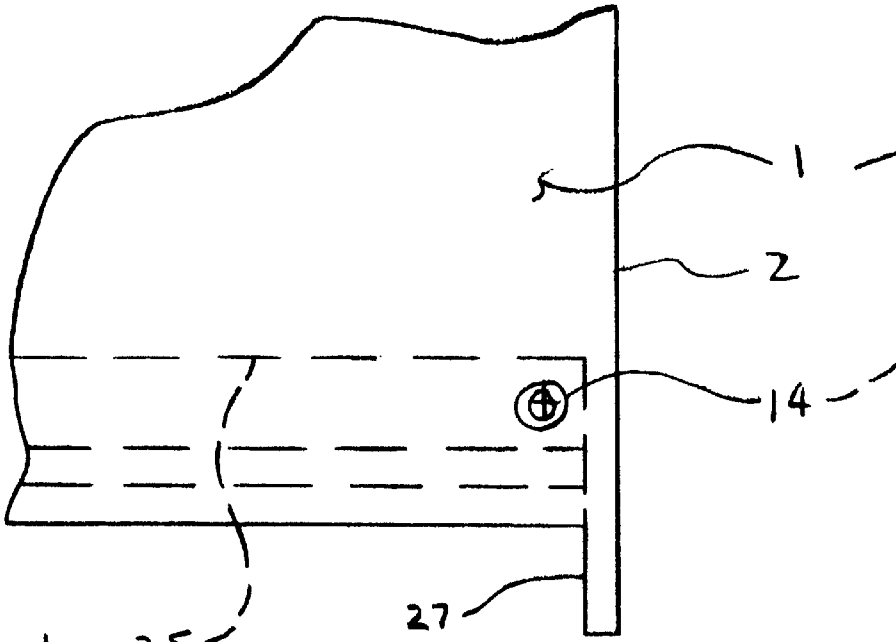
Figure 25C:
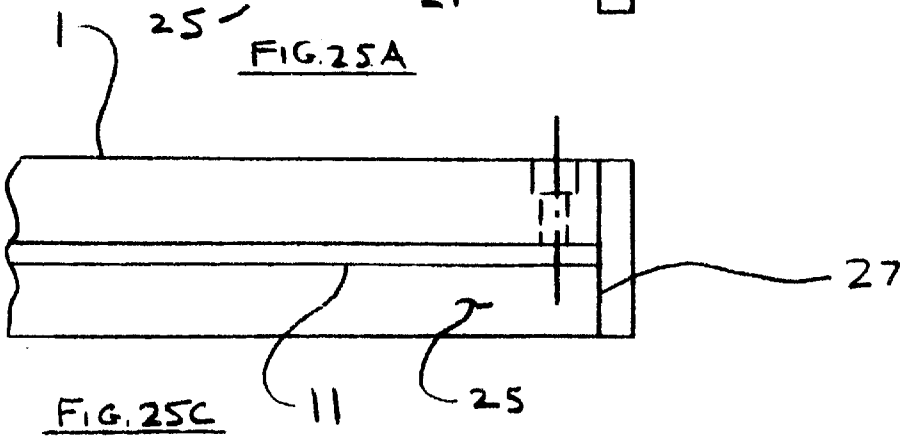
Figures 26A, 26B, 26C, 26D:
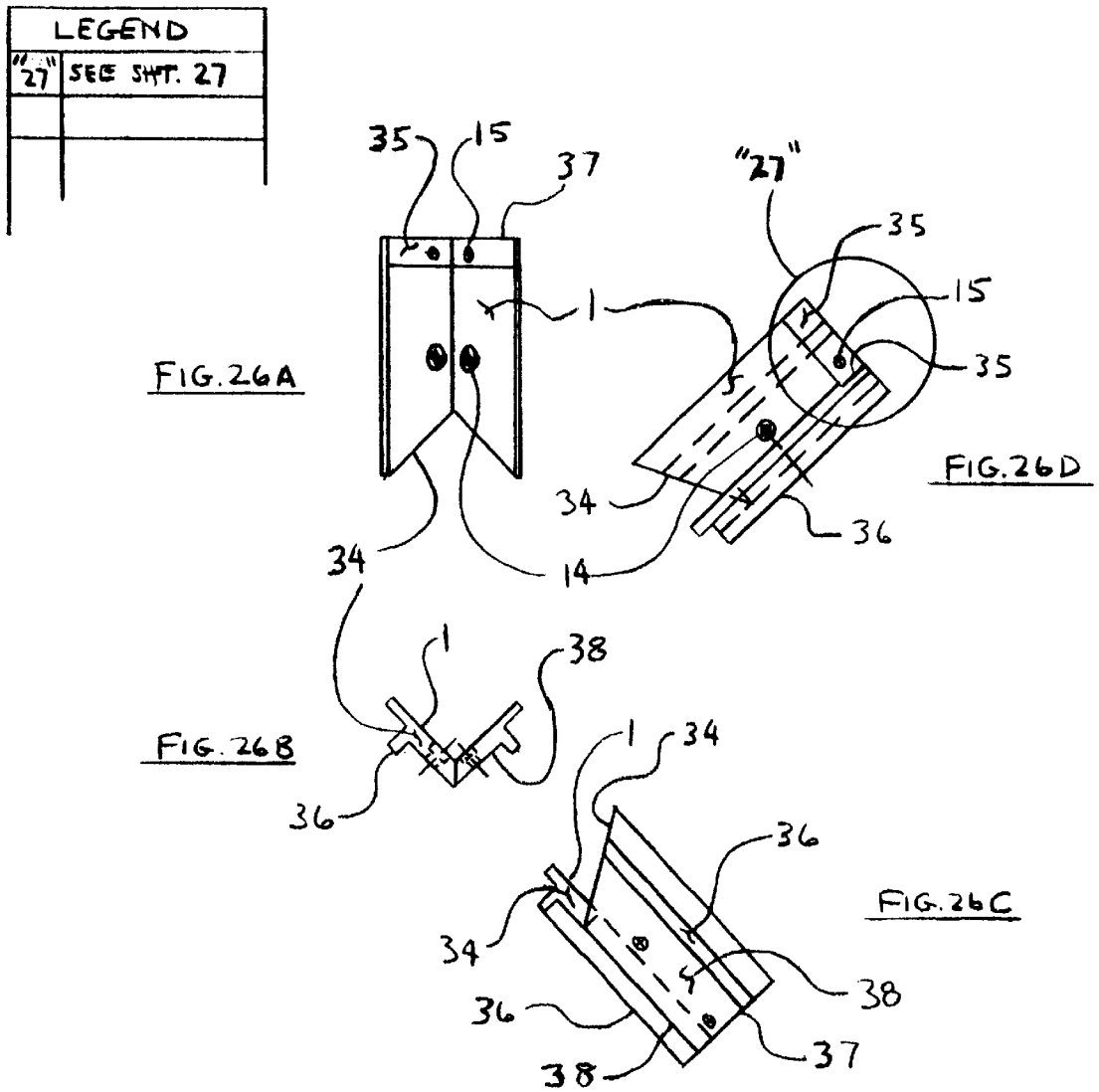
FIGS. 26A–26D, Sheet 26—show a plan view of a Valley Saddle Starter Panel.
Figure 27B:
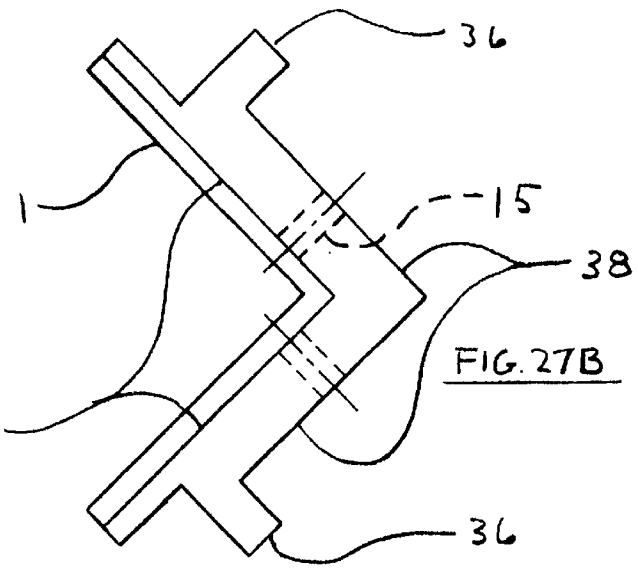
FIGS. 27A & 27B, Sheet 27—show an enlarged, partial plan view of the panel shown in FIG. 26D.
Figure 27A:
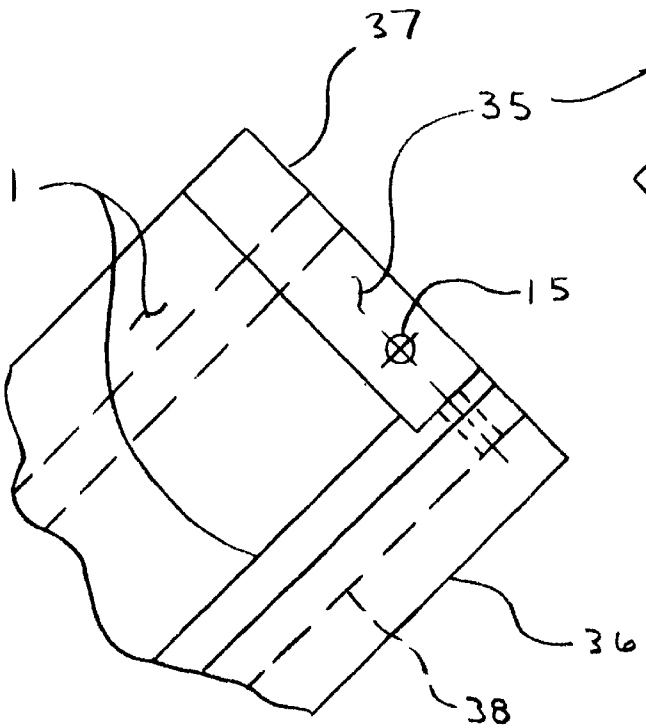
Figures 34A, 34B:
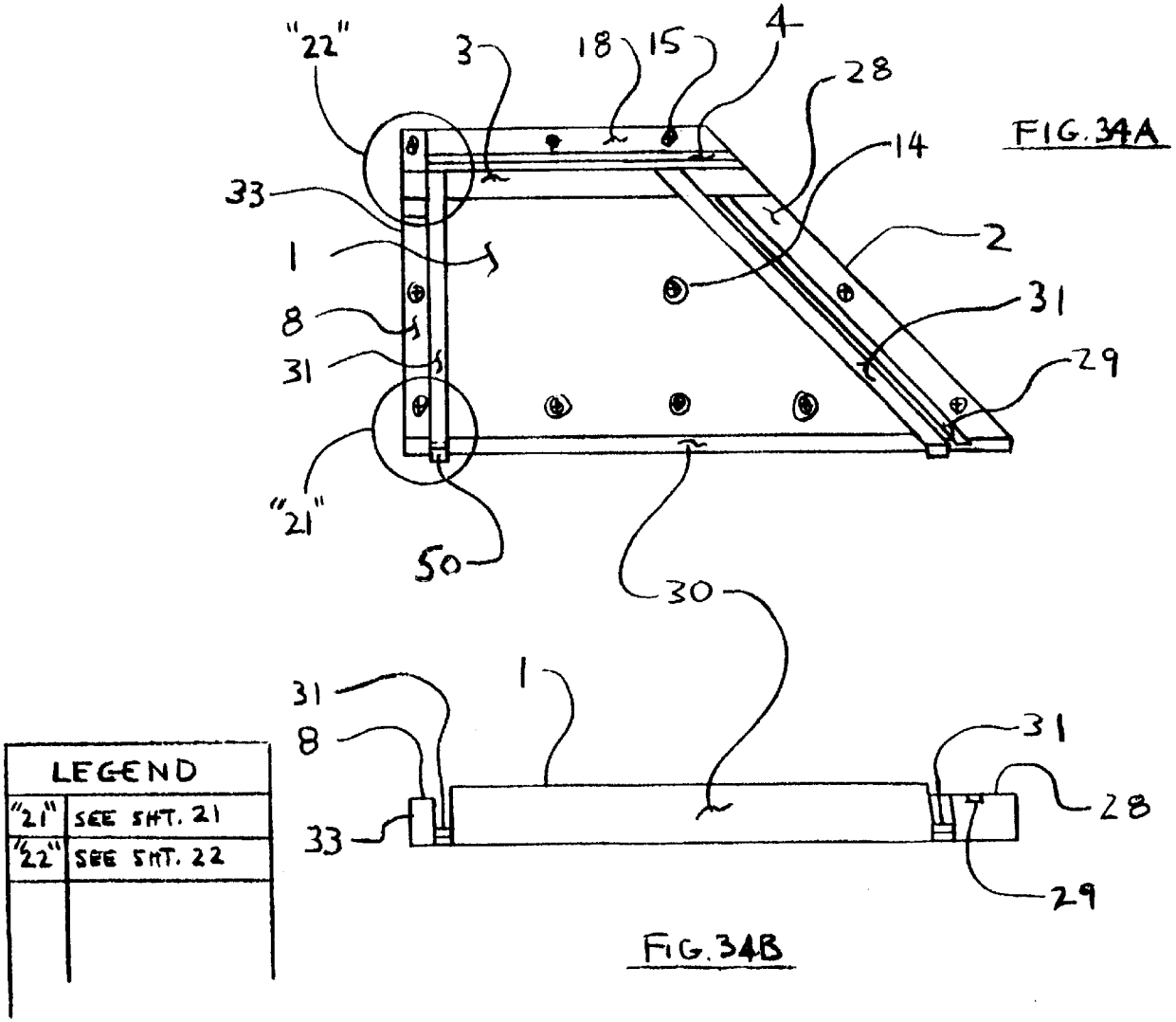
FIGS. 34A & 34B, Sheet 34—show a plan view of a left-hand Hip Joint Starter Panel.

The installation process begins by installing a starter course comprised of a right hand (RH) Starter End Panel FIGS. 16A–16C followed by Standard RH Starter Panels FIG. 18 and finally a RH Valley Starter Joint Panel FIGS. 17A–17D, RH Hip Starter Joint Panel FIGS. 34A–B or a LH Starter End Panel to complete this section of the first course. Each subsequent panel following the initial Starter End Panel is positioned on the roof structure in the manner depicted in FIG. 37 wherein the trailing edge 2, overlaps the leading edge 33 of the previously laid panel. The position of each subsequent panel is assured in that the downward facing lateral overlap shoulder 13,22 which lies perpendicular to the trailing edge 2 of the overlapping panel projects into and interlocks with the upward facing lateral water channel 5 of the previously laid panel.

Figure 37:
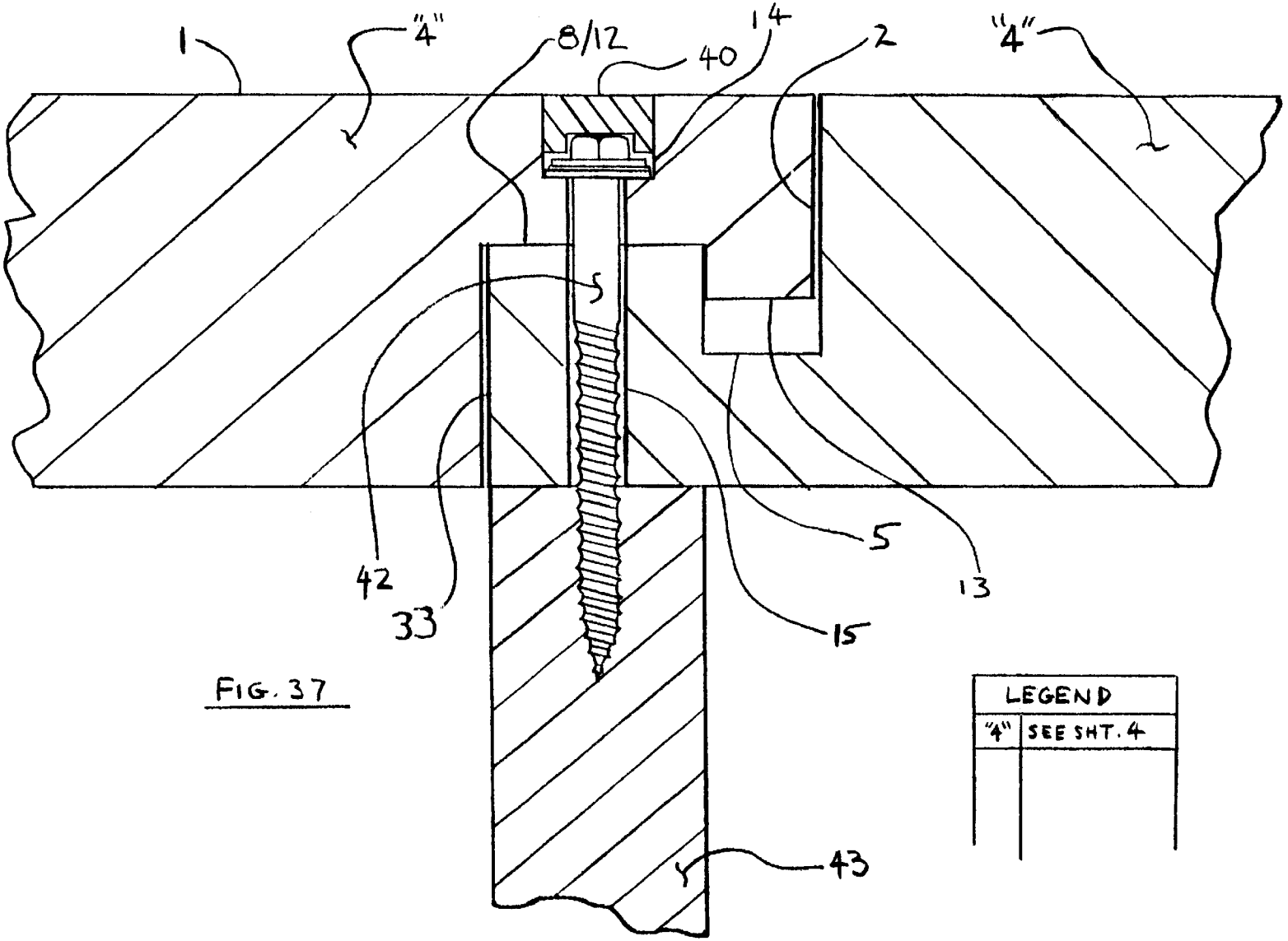
FIG. 37, Sheet 37—shows an enlarged, sectional assembly view of a typical longitudinal lap joint between (2) panels as shown in FIGS. 4A–4C.
Figure 38:
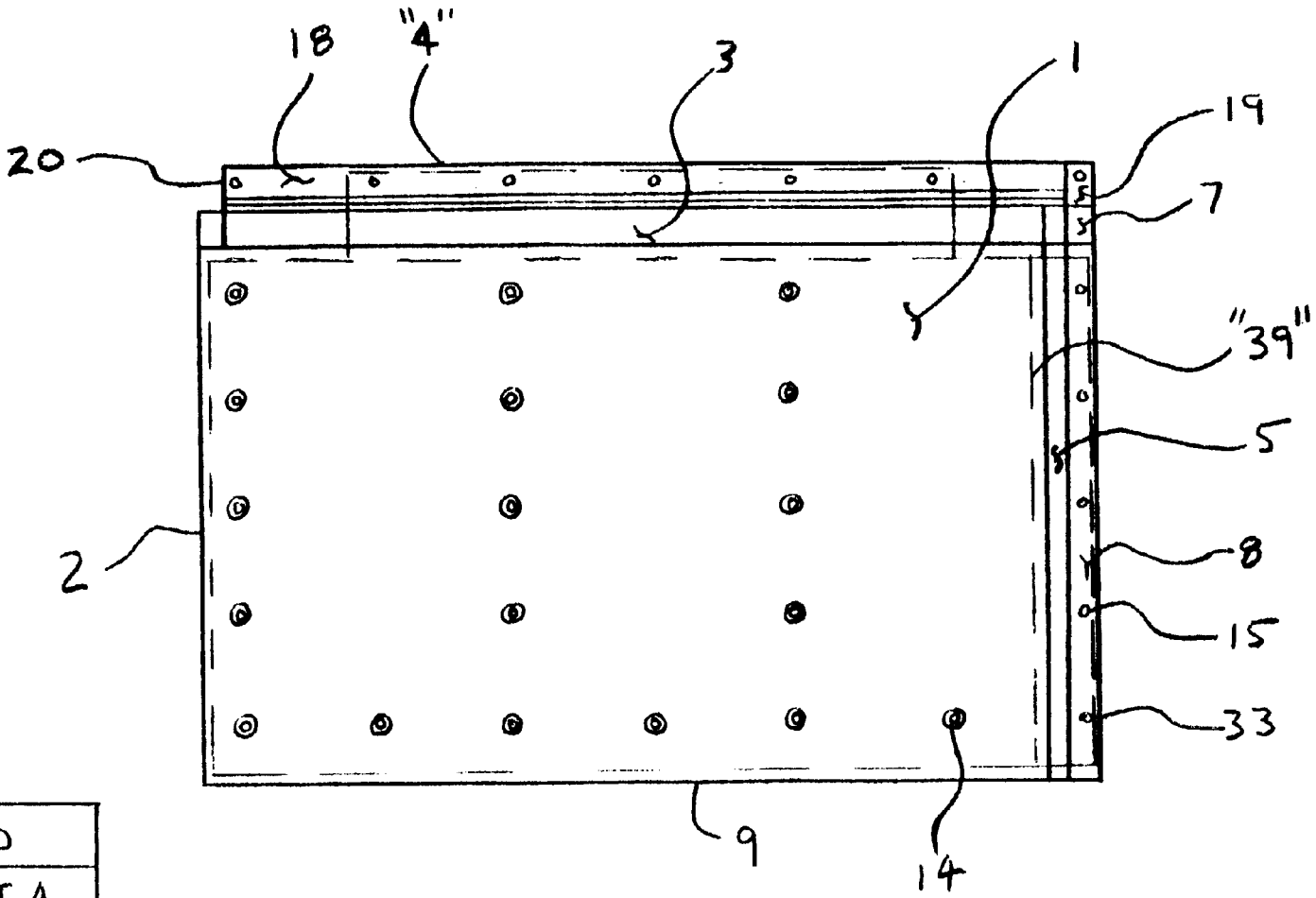
FIG. 38, Sheet 38—shows a left-hand version of a full size Standard Field Panel and a hidden line outline of a fiberglass mesh sheet embedded in the panel.
Figure 39A:
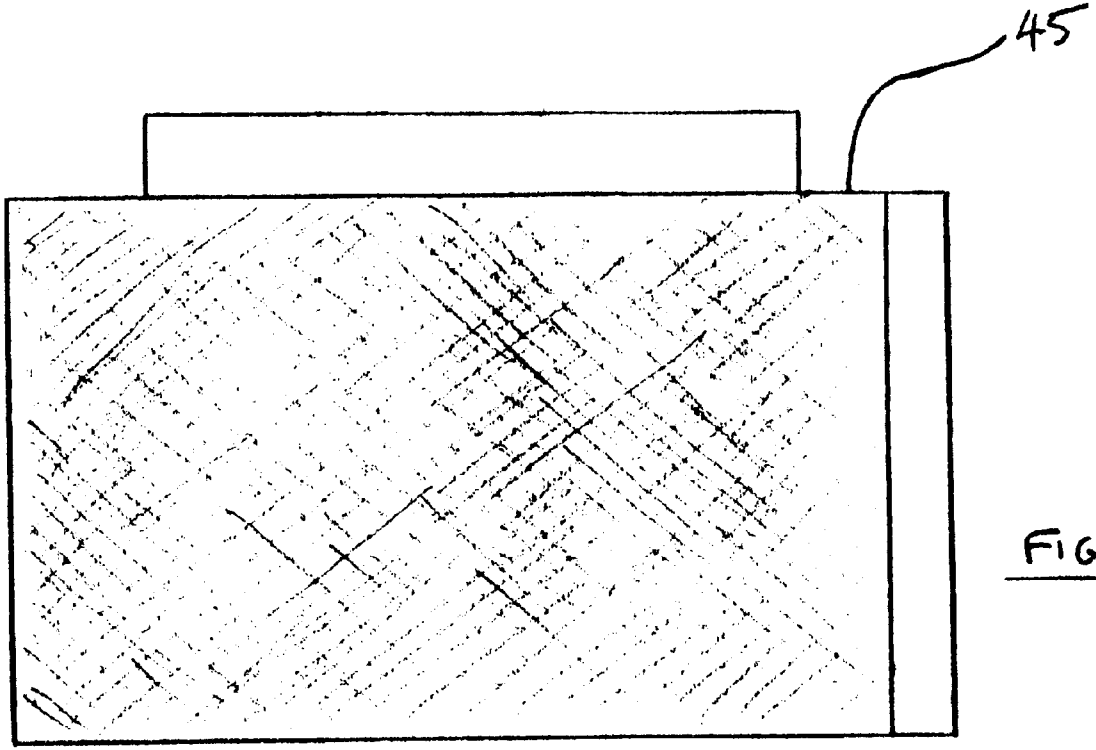
FIGS. 39A–39C, Sheet 39—shows a plan view of the formed Fiberglass Mesh Sheet that is encapsulated during the molding process.
Figure 39B:
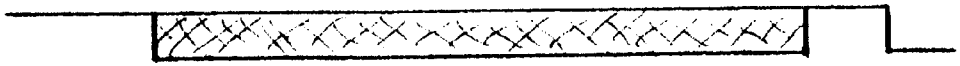
Figure 39C:
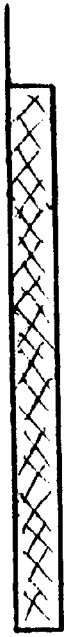

This over lap method is further enhanced when the fasteners 42 are fully tightened as depicted in FIG. 37 and the upward facing surface of the lateral under-lap shoulder 8 on the underlapping panel comes in contact with the downward facing lateral over-lap channel 12 of the overlapping panel. The plurality of panels are positioned on the roof trusses or rafters such that the fastener holes 14,15 align vertically with the top edge of the rafters 43 as further depicted in FIG. 37.

Figures 12A, 12B:
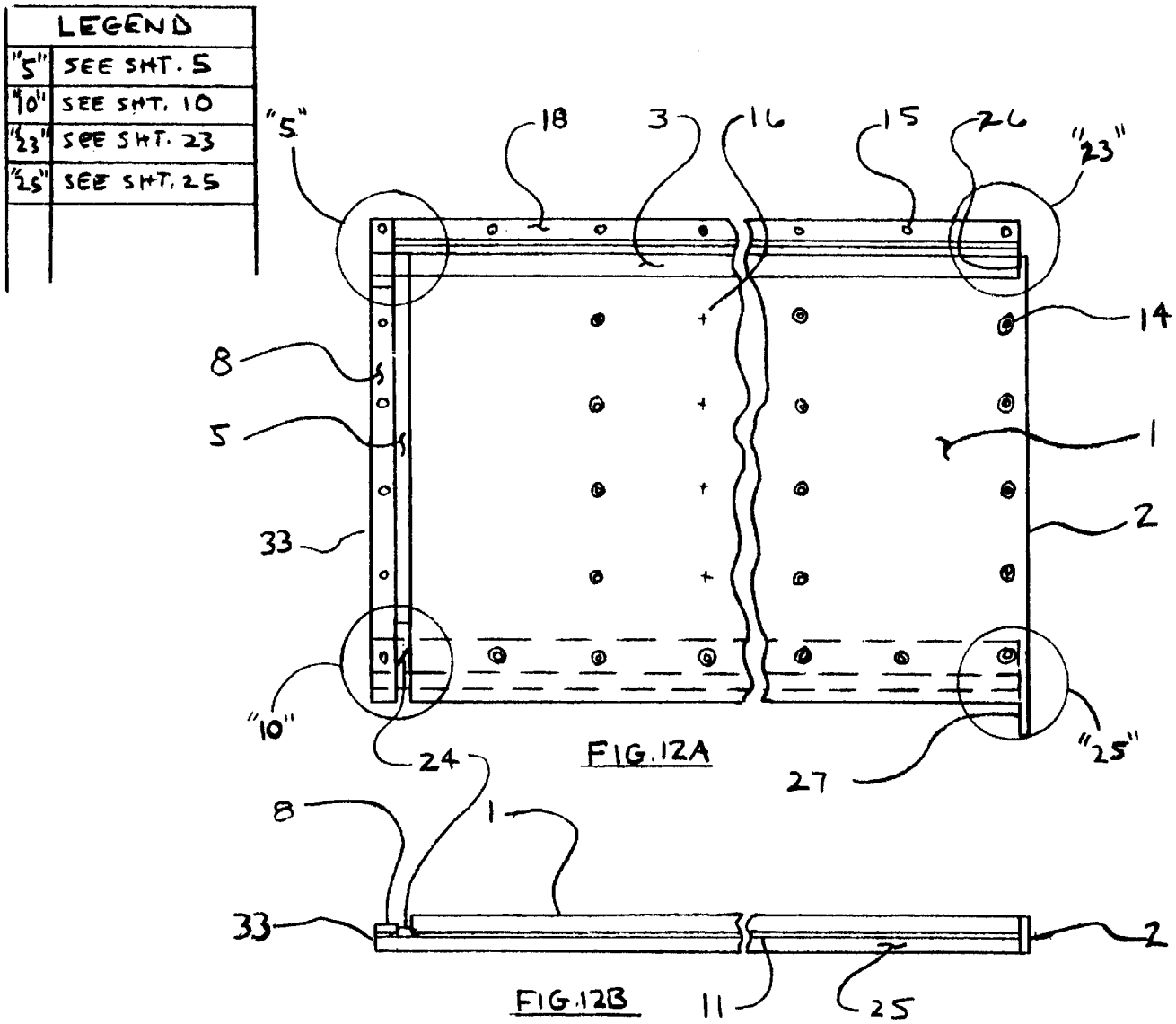
FIGS. 12A & 12B, Sheet 12—show a plan view of a right-hand version of a full size End Panel.
Figures 35A, 35B, 35C:
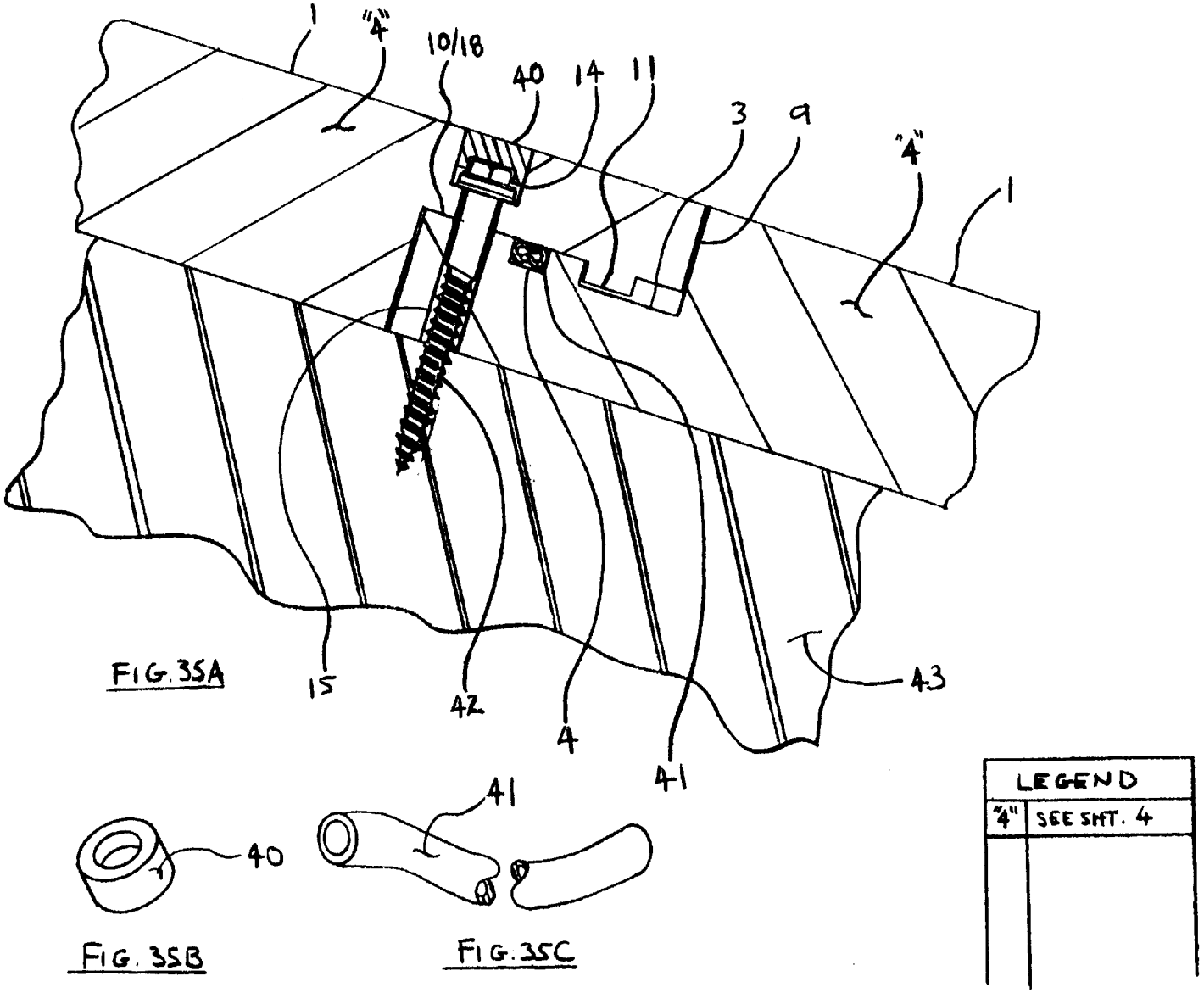
FIG. 35A, Sheet 35—shows an enlarged, sectional assembly view of a typical horizontal lap joint between (2) panels as shown in FIGS. 4A–4C.
FIG. 35B, Sheet 35—shows a perspective view of a Fastener Hole Plug as depicted in FIG. 35A.
FIG. 35C, Sheet 35—shows a perspective view of a partial length of the Extruded Panel Seal as depicted in FIGS. 35A & 36.

The second course is begun by placing a RH Standard End Panel FIG. 12A on the roof structure such that its lower edge overlaps the top edge of the starter course as illustrated in FIG. 35A. In this manner, when the plurality of fasteners 42 are tightened down, the upward facing shoulder surface 18 of the underlapping panel and the downward facing surface 10 of the overlapping panel meet and exert the required compression to the seal 41. The second course is continued by positioning a RH Standard Field Panel FIGS. 1A–1B and 4A–4C such that the lower edge of the Field Panel overlaps the upper edges of the starter course panels as illustrated in FIG. 35A wherein the downward facing horizontal over-lap locating rib 11 of the overlapping panel projects into and interlocks with the upward facing horizontal water channel 3 of the underlapping panel.

Figures 13A, 13B:
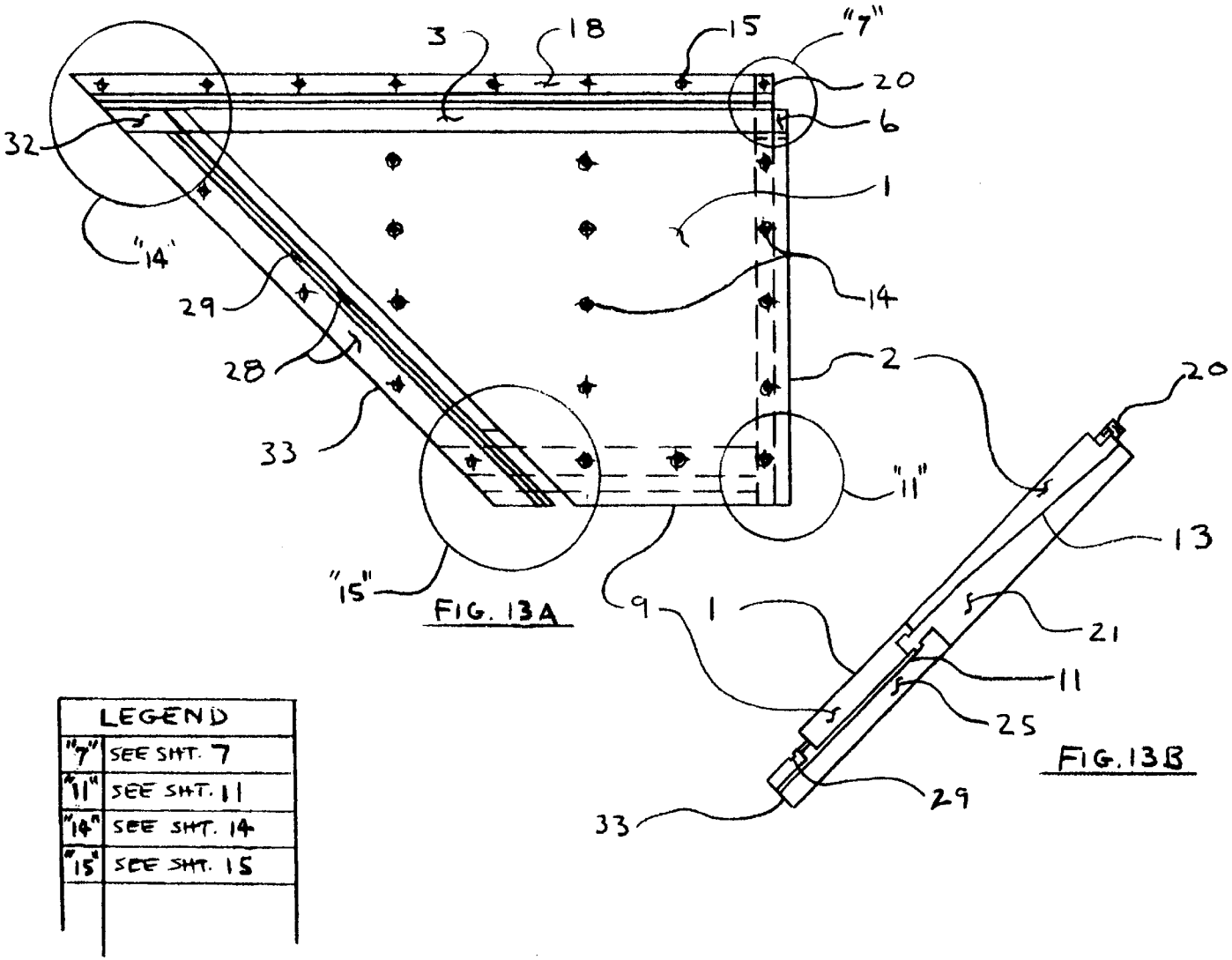
FIGS. 13A & 13B, Sheet 13—show a plan view of a right-hand version of a Valley Joint Panel.
Figure 14A:
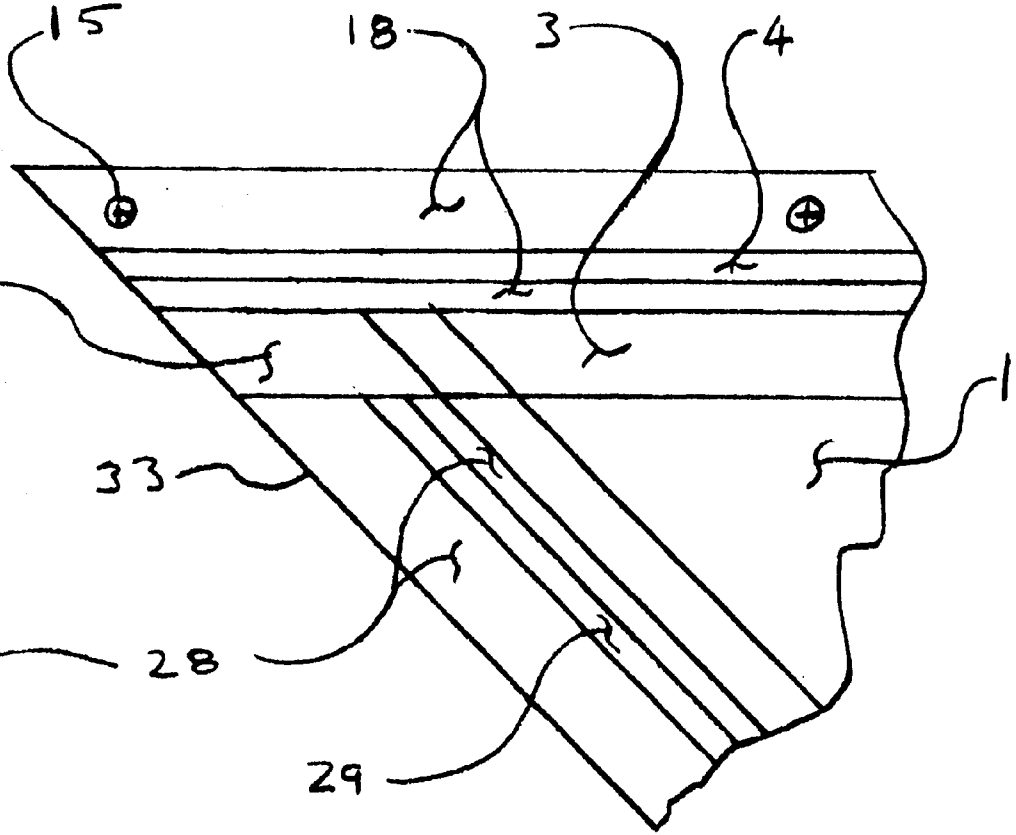
FIGS. 14A & 14B, Sheet 14—show an enlarged, partial plan view of the upper left corner of the panel shown in FIGS. 13A & 17A.
Figure 14B:
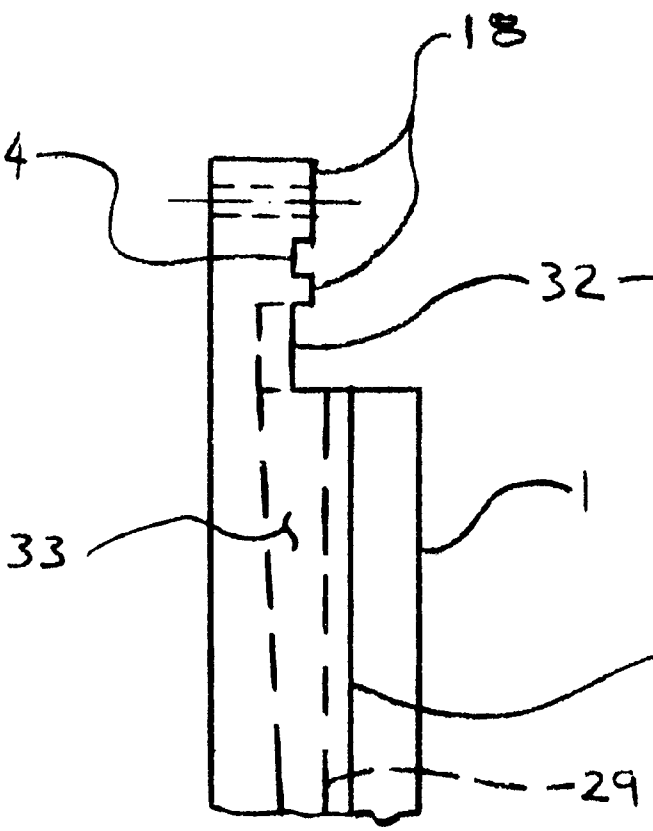
Figures 15A, 15B, 15C:
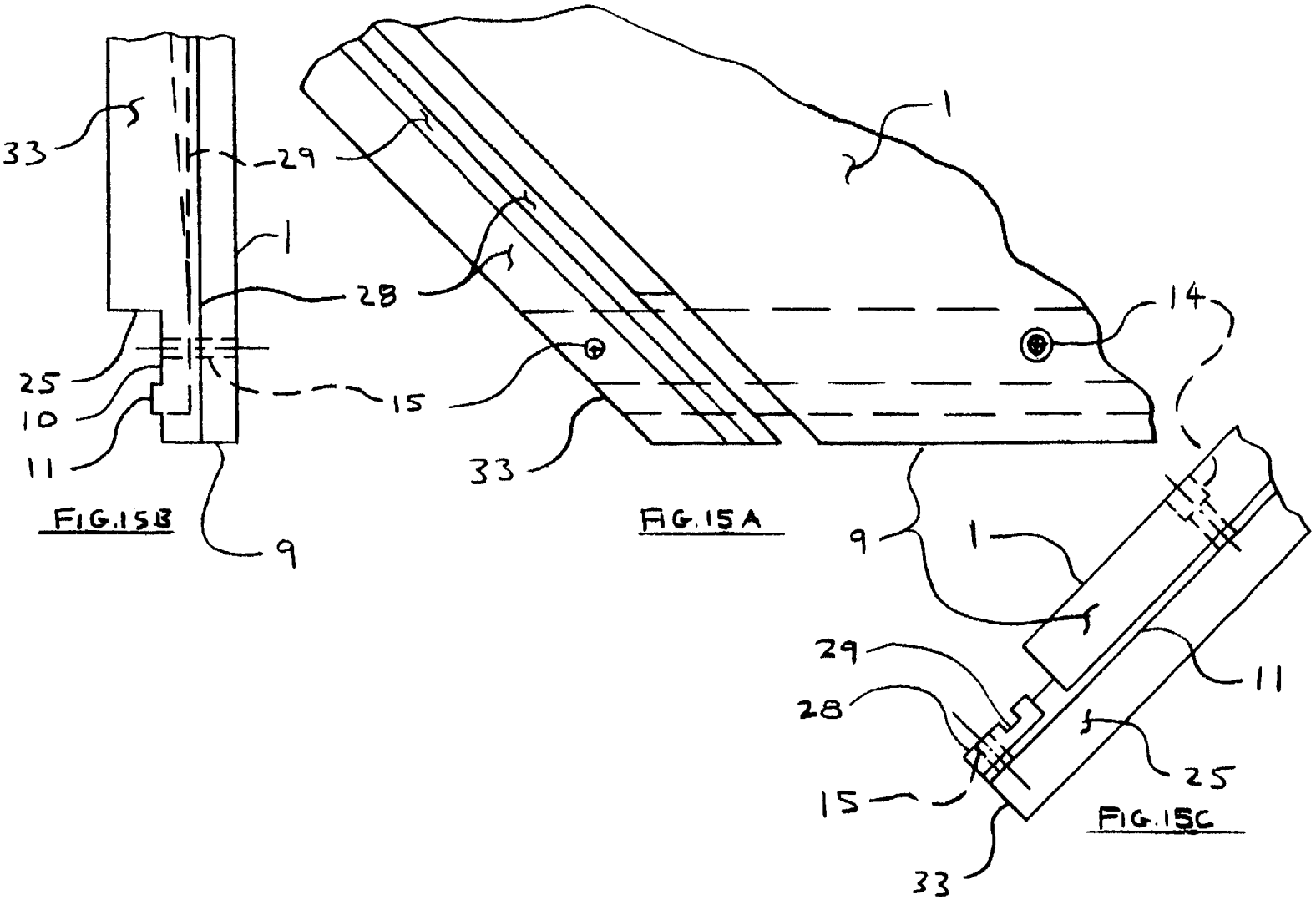
FIGS. 15A–15C, Sheet 15—show an enlarged, partial plan view of the lower left corner of the panel shown in FIG. 13A.
Figures 33A, 33B:
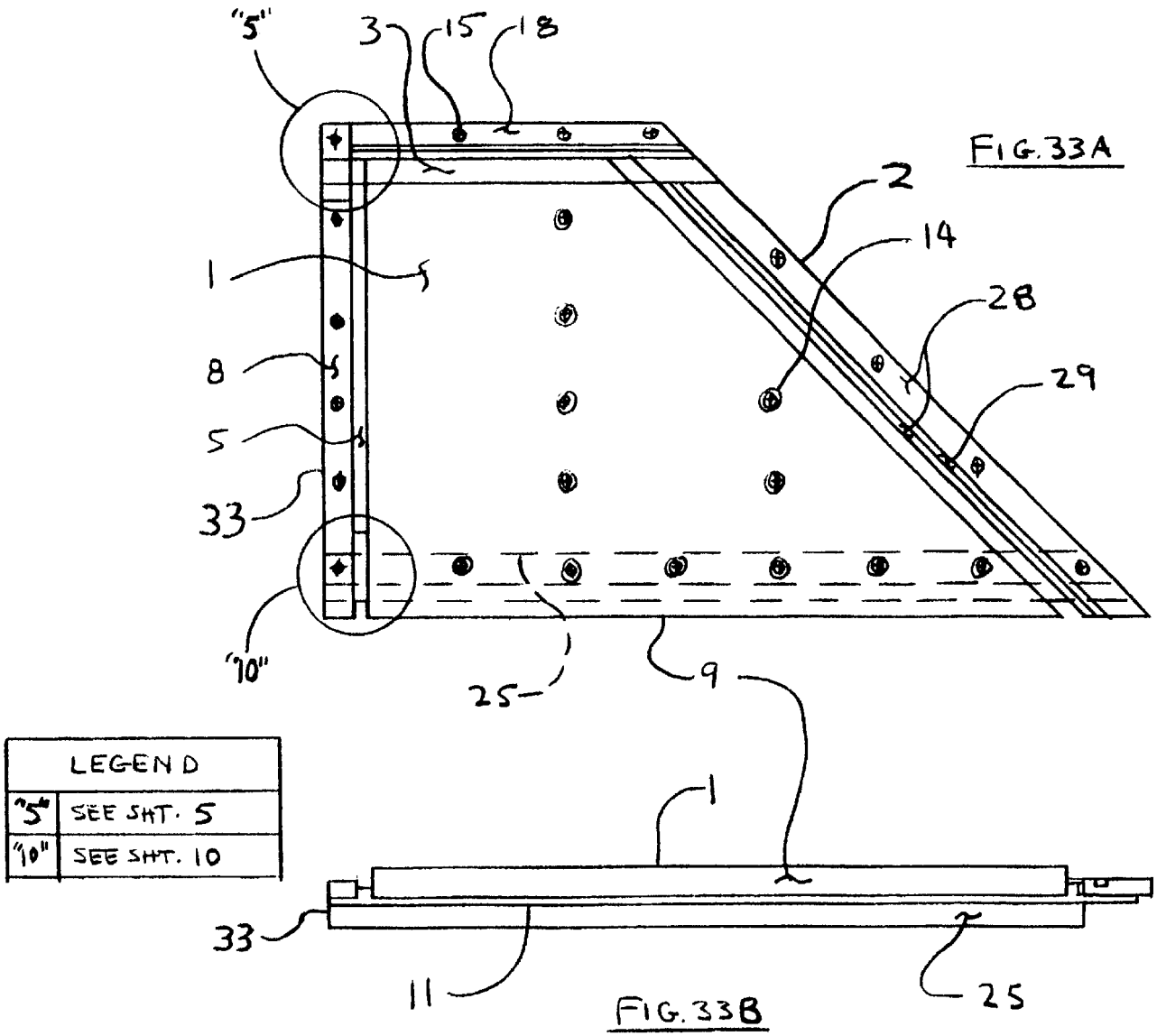
FIGS. 33A & 33B, Sheet 33—show a plan view of a left-hand Hip Joint Panel.

The trailing edge of the Field Panel 2 overlaps the leading edge of the End Panel as further illustrated in FIG. 37. This method continues by positioning a LH Standard Valley Joint Panel FIGS. 13A–13B, LH Standard Hip Joint Panel FIGS. 33A–33B or LH End Panel such that the course for this roof section is complete.

This preferred method of installation is continued for each subsequent course until the uppermost portion of the roof structure is covered as illustrated in FIG. 2. For roof structures that incorporate hip or valley style construction, each individual roof plane or section is completed in the manner described above followed by the installation of the specific hip or valley panel components as further illustrated in FIG. 2.

A primary feature of the current invention is the declining upward facing surfaces of the horizontal, lateral and diagonal water channels of each of the "non-starter" course panel types. For all of the starter course panels the lateral or diagonal water channels are not declining in nature but run parallel to the panel face as depicted in FIGS. 16A–16B, 17A–17B, 18, 21A–21B and 22A–22B. Referring to FIG. 35A, which shows an angled sectional view of a horizontal head-lap seam between adjoining panels on differing courses, the reader will note that as water runs off of the roof structure surface 1, it will inevitably reach a seam 9 where the overlapping and underlapping panels meet. The majority of water will pass over this seam but it is likely that some water will penetrate the seam assisted by gravity and wind.

Figures 4A, 4B, 4C:
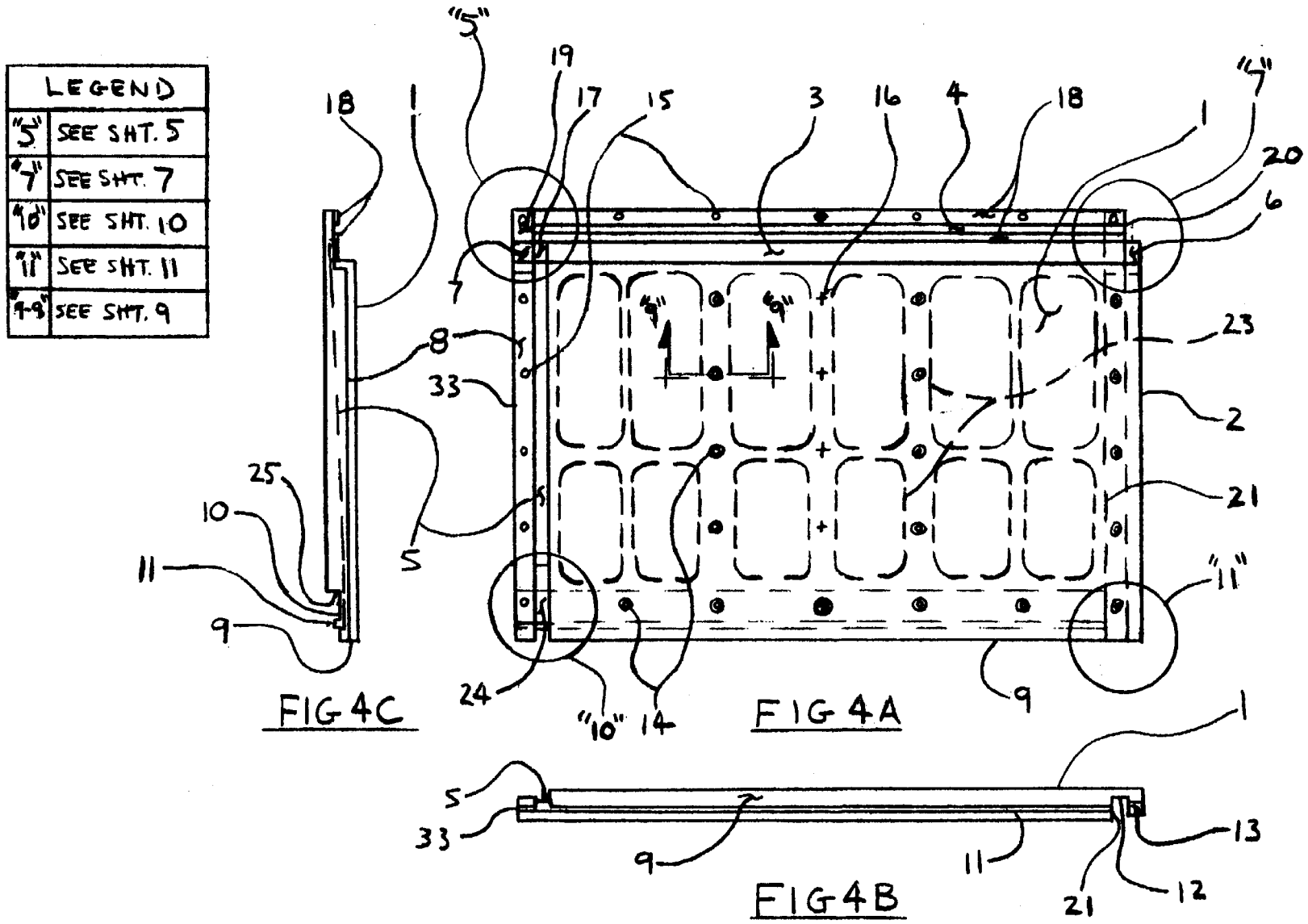
FIGS. 4A–4C, Sheet 4—show a plan view of a right-hand version of a full size Standard Field Panel.
Figures 5A, 5B:
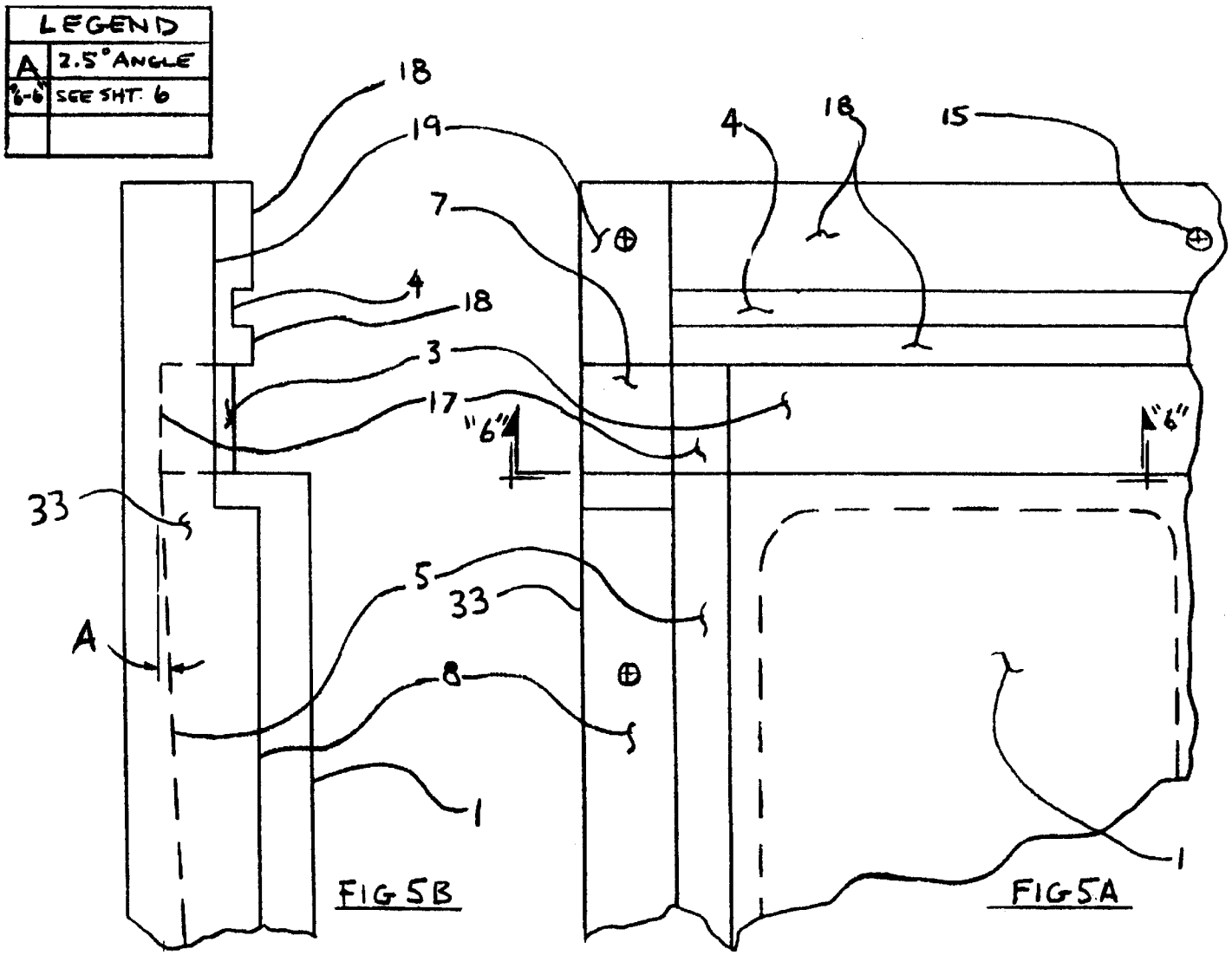
FIGS. 5A & 5B, Sheet 5—show an enlarged, partial plan view of the upper left corner of the panel shown in FIGS. 4A, 12A & 33A.
Figure 6:
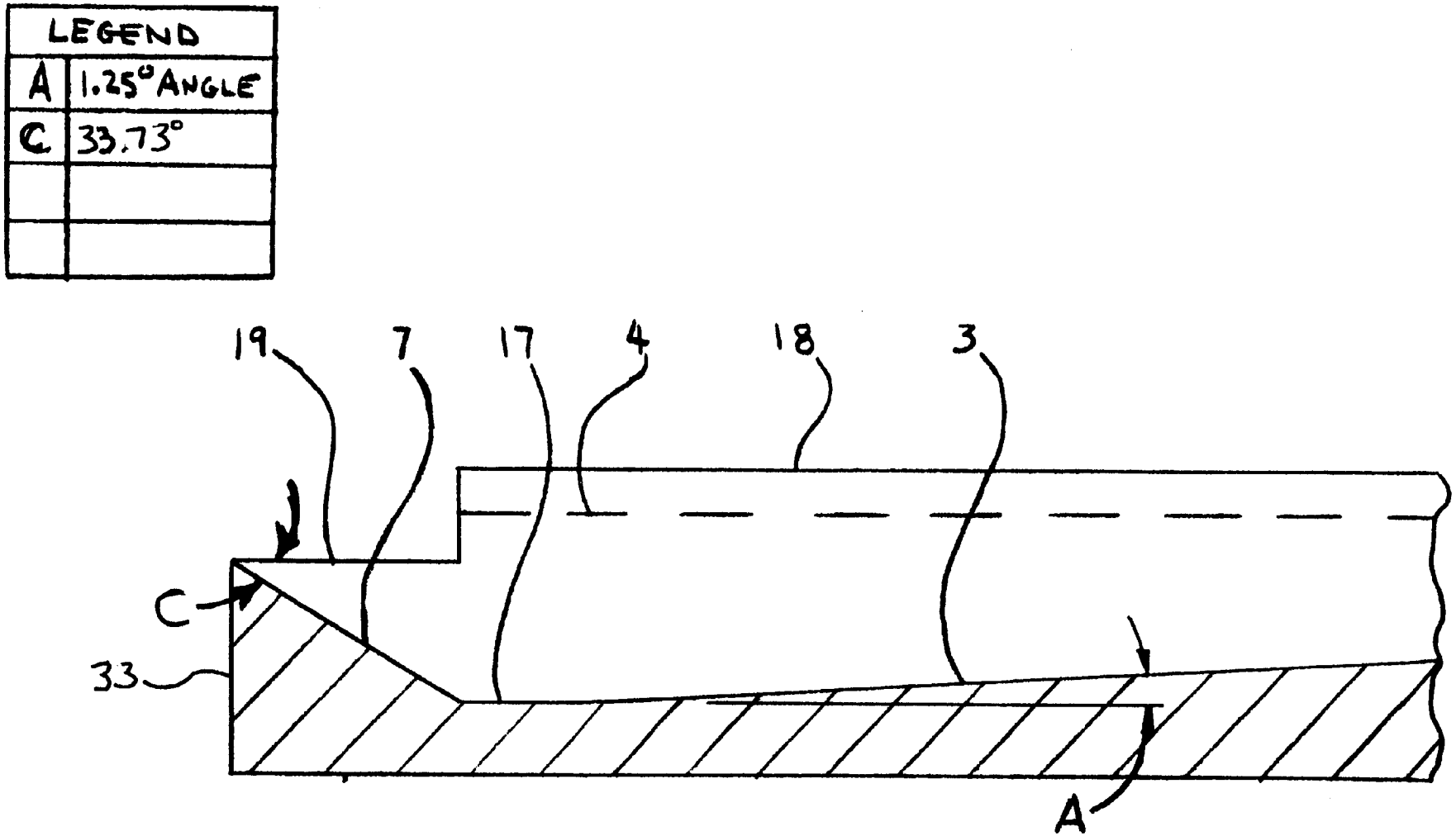
FIG. 6, Sheet 6—shows an enlarged cross-sectional view taken along the line 6—6 of FIG. 5A.
Figures 7A, 7B:
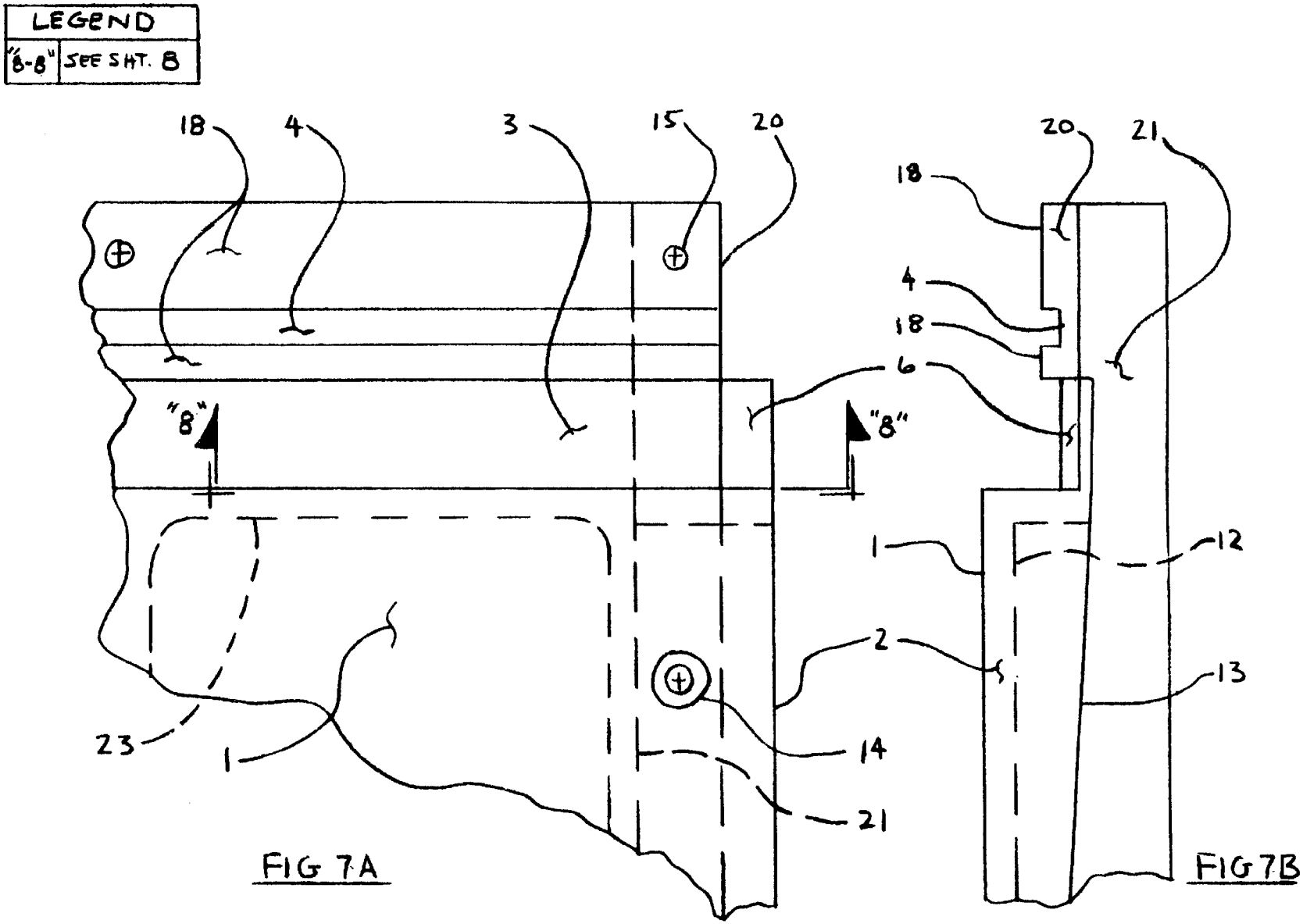
FIGS. 7A & 7B, Sheet 7—show an enlarged, partial plan view of the upper right corner of the panel shown in FIGS. 4A, 13A, 17A & 18.
Figure 8:
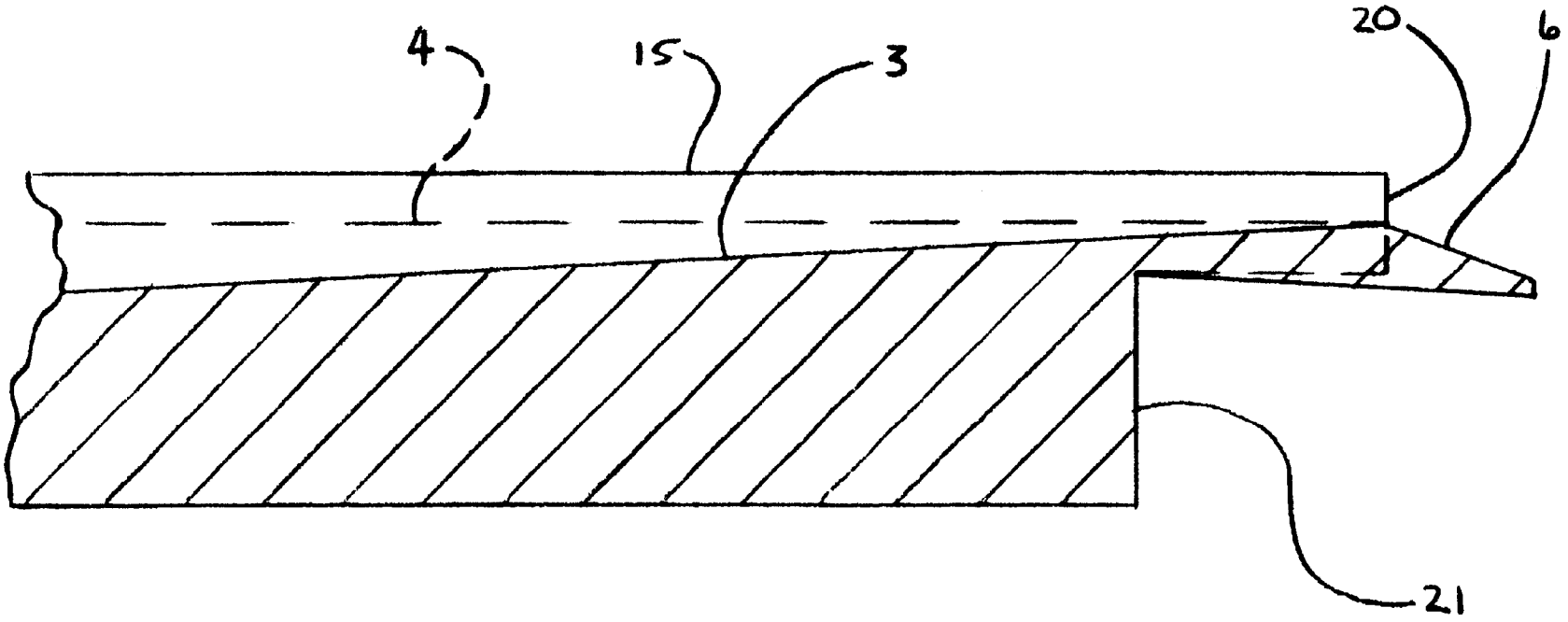
FIG. 8, Sheet 8—shows an enlarged cross-sectional view taken along the line 8—8 of FIG. 7A.
Figure 9:
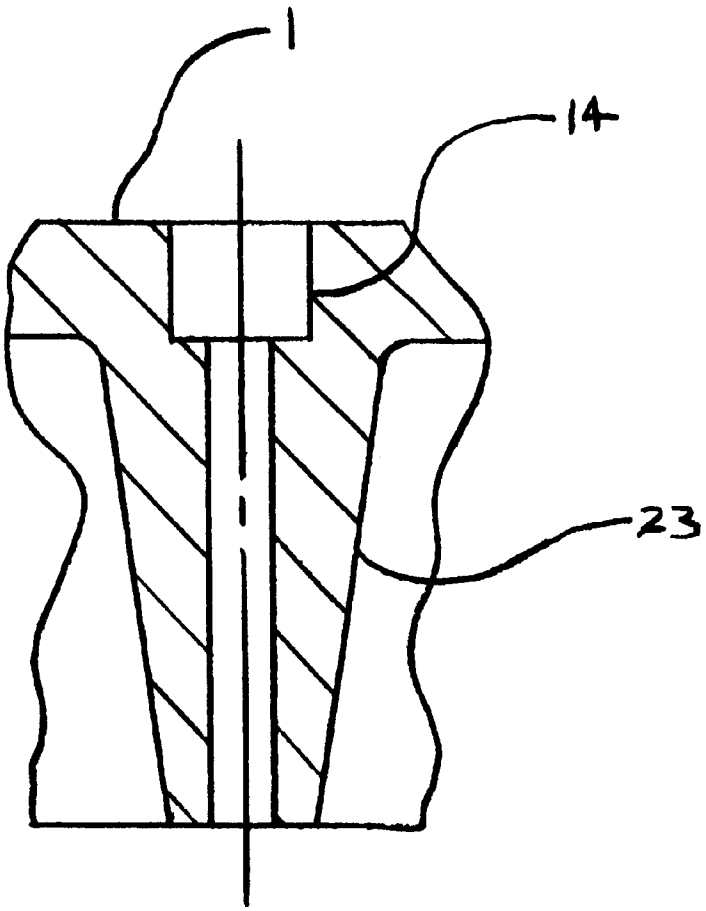
FIG. 9, Sheet 9—shows an enlarged cross-sectional view taken along the line 9—9 of FIG. 4A.
Figures 10A, 10B:
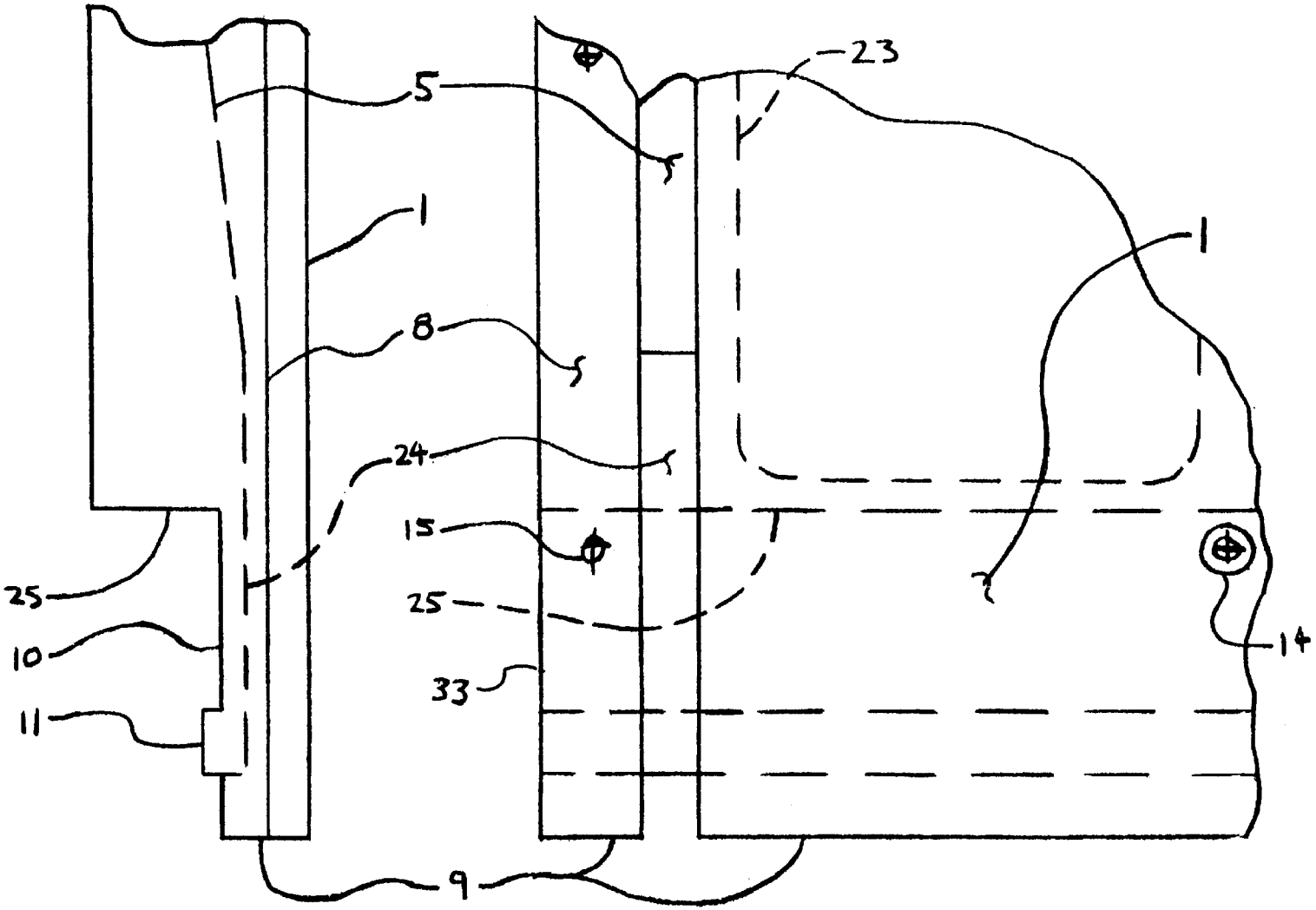
FIGS. 10A & 10B, Sheet 10—show an enlarged, partial plan view of the lower left corner of the panel shown in FIGS. 4A, 12A & 33A.
Figures 11A, 11B:
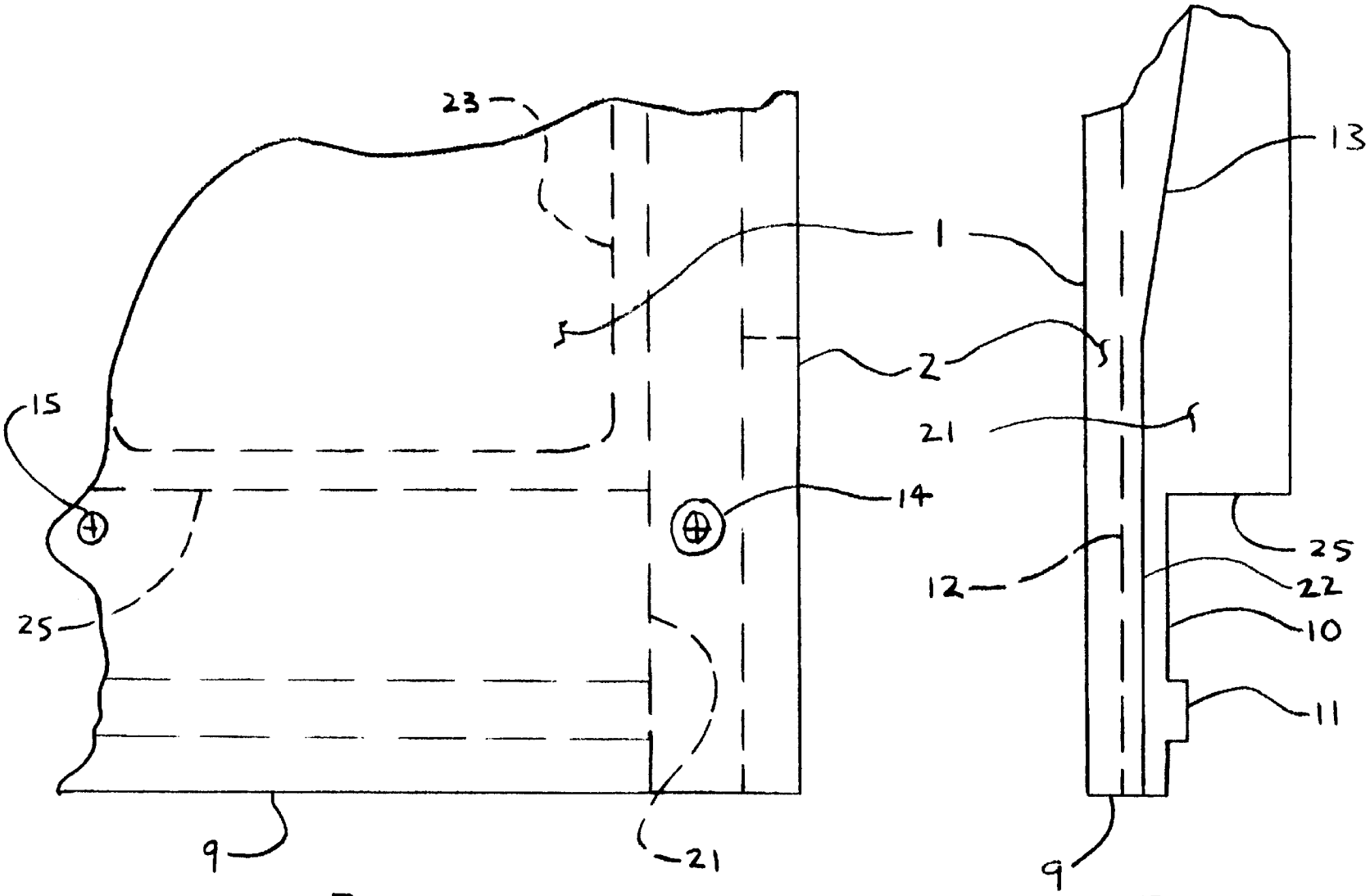
FIGS. 11A & 11B, Sheet 11—show an enlarged, partial plan view of the lower right corner of the panel shown in FIGS. 4A & 13A.

The penetrating water will reach the upward facing horizontal water channel 3 and the horizontal water channel flap 6 as illustrated in FIGS. 4A, 7A and 8, of the underlapping panel. Referring now to FIGS. 4A, 5A–5B, 6, 7A, 8, 10A–10B and 11A–11B the reader will see that the horizontal water channel 3 declines from right to left at an angle of 1.25 degrees, the horizontal water channel flap 6 declines in the opposite direction. Water on surface 3 will flow down-left converging with the water channel transition 17. Water on surface 6 will flow down-right and fall to the horizontal water channel return 7 of the adjacent underlapping panel eventually converging with the water channel transition 17 of the same panel.

Water will continue flowing "down" the slope of the roof structure from 17 by continuing its path along the lateral water channel 5, which inclines away from 17 at an angle of 2.5 degrees up to the level of the lateral water channel transition 24 where it eventually spills over the head-lap seam with the lower course. When a roof is constructed at the minimum pitch of 3:12, (roughly equivalent to 14 degrees) as shown in FIG. 35A, the inclining lateral water channel sits at a relatively declining angle allowing the water to continue "down" the roof structure. In this manner, the depth, length and volume of the water channels on each full size panel are sufficient to shed more than two gallons per minute (GPM). This flow rate is more than enough to shed the relatively minuscule volume of water that may penetrate the seams between panels when realizing that most of the water will run directly off of the roof surface.

It is important to note that any of the panel types described herein can be manufactured in either a left hand or right hand version to facilitate any combination requirements. When speaking of a left or right hand version and no figure number is referenced, it can be assumed that the panel in question is an exact mirror image of the opposite version. For instance, a standard LH version of a Valley Joint Starter Panel has no drawing included herein but is an exact mirror image of the standard RH Valley Joint Starter Panel as shown in FIGS. 17A–17D.

A typical hip section is completed by first positioning a Hip Saddle Starter Panel FIG. 31A–31E. over the upward facing diagonal ends of the opposed LH and RH Starter Hip Joint Panels FIGS. 34A–34B. A standard Hip Saddle Panel FIG.32A–32C is then positioned such that the down-sloping, trailing edge 34 of the standard Hip Saddle Panel overlaps the up-sloping, leading edge 37 of the Hip Saddle Starter Panel and the downward facing surface of the hip saddle over-lap 39 rests on the upward facing surface of the hip saddle under-lap 35. Each Hip Saddle Panel interlocks with the corresponding LH and RH Hip Joint Panels such that the downward facing lateral locating ribs 36 of the Hip Saddle Panel project into the upward facing diagonal water channel 31 of the Hip Joint Panels. Once the Hip Saddle Panel is properly positioned the fasteners 42 are tightened which brings the downward facing surface 38 of the Hip Saddle Panel into contact with the upward facing surface of the Hip Joint Panel shoulder 28. In this manner the panels exert the required compression to the seal 41 located in the diagonal seal channel 29 of the Hip Joint Panel. This process is repeated on up the hip until reaching the ridge.

Figures 28A, 28B, 28C:
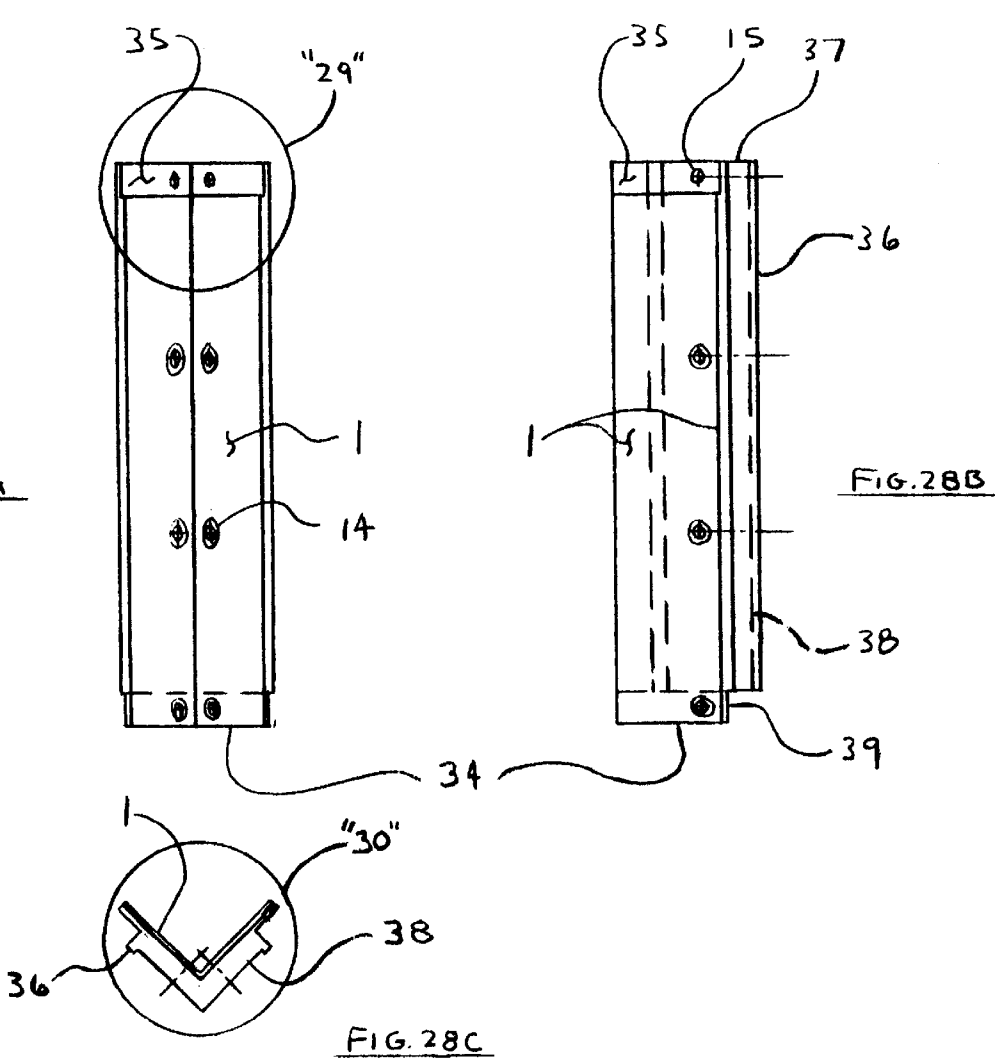
FIGS. 28A–28C, Sheet 28—show a plan view of a Standard Valley Saddle Panel.
Figure 29B:
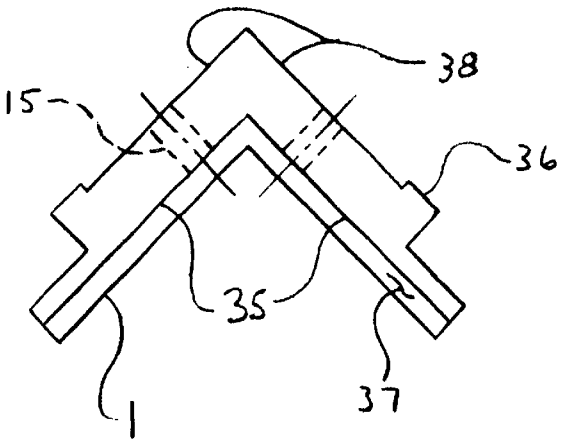
FIGS. 29A & 29B, Sheet 29—show an enlarged, partial plan view of the panel shown in FIG. 28A.
Figure 29A:
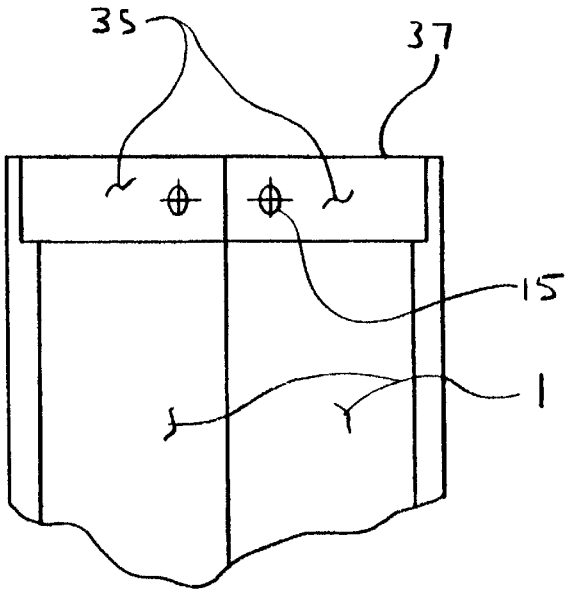
Figures 30A, 30B, 30C:
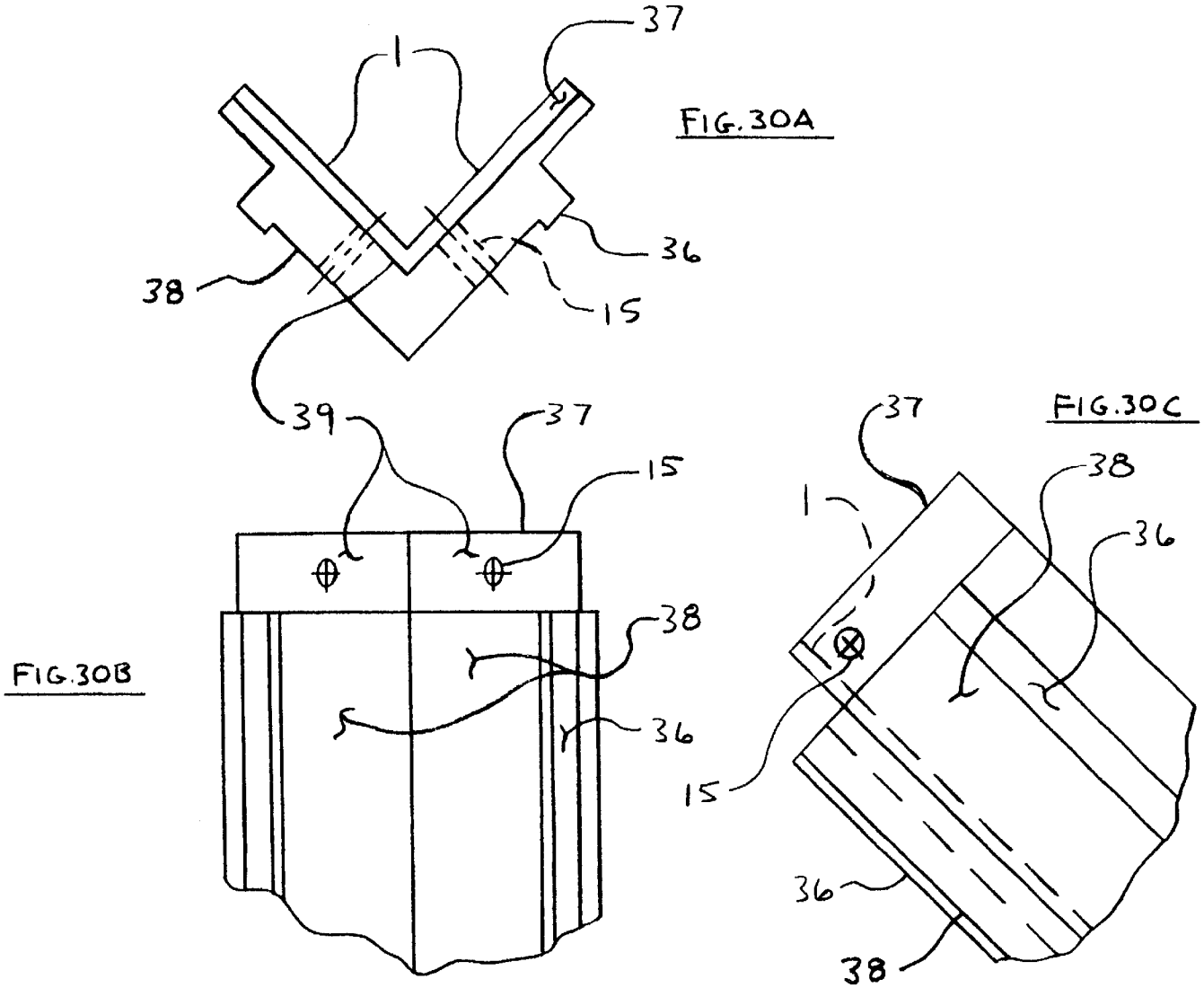
FIGS. 30A–30C, Sheet 30—show an enlarged, partial plan view of the panel shown in FIG. 28C.
Figures 31A, 31B, 31C, 31D, 31E:
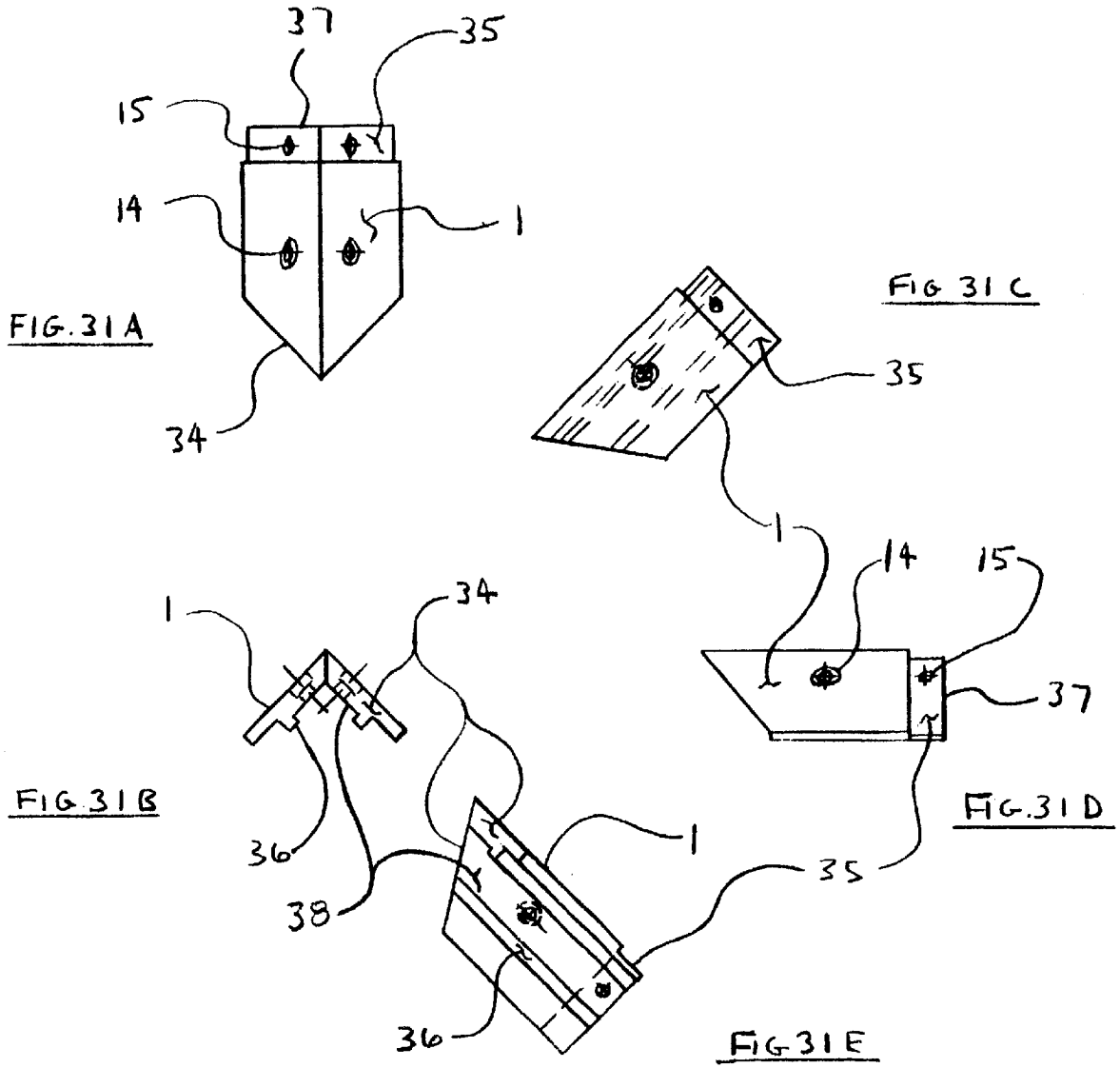
FIGS. 31A–31E, Sheet 31—show a plan view of a Hip Saddle Starter Panel.

A typical valley section is completed in a similar manner wherein a Valley Saddle Starter Panel FIGS. 26A–26D is positioned such that it overlaps the upward facing diagonal ends of the LH and RH Valley Starter Joint Panels FIGS. 17A–17D. A standard Valley Saddle Panel FIGS. 28A–28C is then positioned such that the down-sloping, trailing edge 34 of the standard Valley Saddle Panel overlaps the up-sloping, leading edge 37 of the Valley Saddle Starter Panel. Each valley panel interlocks with corresponding LH and RH Valley Joint Panels such that the downward facing lateral locating ribs 36 of the Hip Saddle Panel project into the upward facing diagonal water channel 31 of the Valley Joint Panels. The integral seals of the Valley Joint Panels 41 are compressed in the same manner as described in the previous paragraph. This process is repeated on up the valley until reaching the ridge.

Figure 36:
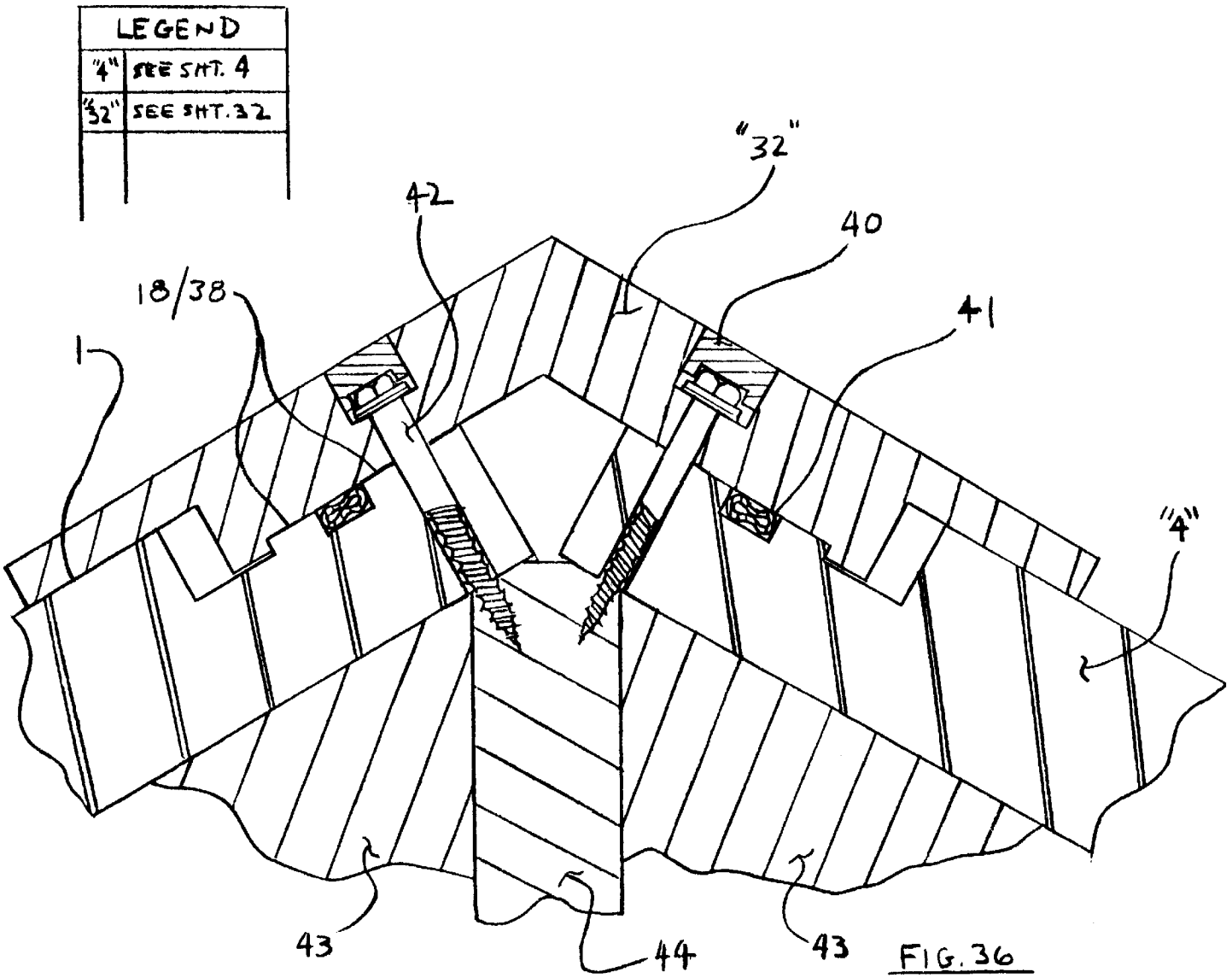
FIG. 36, Sheet 36—shows an enlarged, sectional assembly view of a typical lap joints between a panel as shown in FIGS. 32A–32C and (2) panels as shown in FIGS. 4A–4C as they converge at the ridge of a roof from opposite surfaces.

The final step of completing the roof structure is installing the Ridge Saddles. Ridge Saddles are almost identical to the standard Hip Saddle Panel and are installed by beginning with a Ridge Starter Panel which is identical to a standard Hip Saddle Starter Panel except that both ends are square to the body of the panel unlike the Hip Saddle Starter Panel which has a pointed down sloping end to match the geometry of the roof corner. Each subsequent Ridge Saddle is installed as illustrated in FIG. 36. Once all of the roof panel components have been installed the exposed counter-bored fastener holes are plugged with thermoplastic plugs that match the surface texture and color of the panels and the plugs sit flush with the surface of the roof panel as illustrated in FIG. 35A.

A further note of importance is that in the accompanying drawings, all of the hip and valley joint panels are shown with 45 degree angles at the diagonal ends of the panels. This is done merely for simplicity sake. In an application requiring hip or valley panels the actual angle will vary based on the actual pitch of the roof structure. The required angle is determined prior to manufacturing and is adjusted in the mold tooling.

Figure 40A:
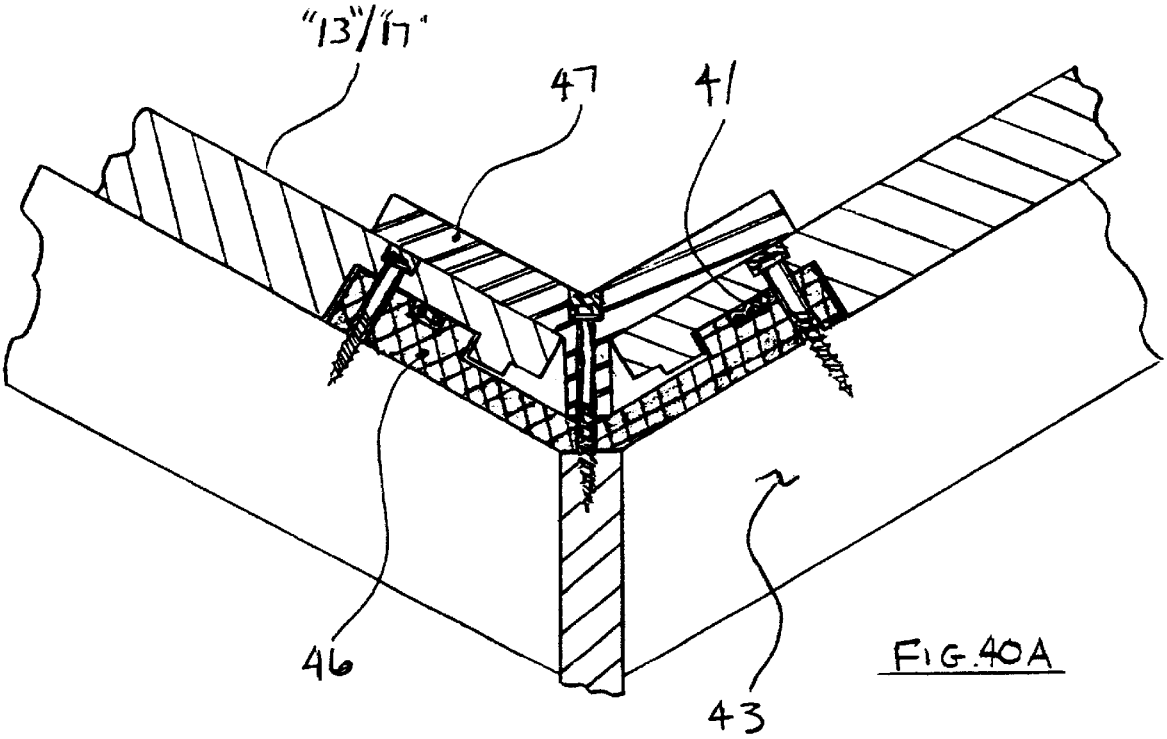
FIG. 40A, Sheet 40—shows an enlarged, sectional assembly view of a typical valley utilizing an alternate embodiment of the invention.

An alternate embodiment of a roof valley structure is illustrated in FIG. 40A wherein the Valley Joint Panels 13/17 overlap the Valley Saddle 46 and are in turn covered by Valley Caps 47. In this configuration a course is begun from the valley and terminates at the gable end or hip. The process of overlapping the panels is done in much the same manner as previously described herein except that the direction of installation would be opposite and would require the opposite hand components (i.e.-left hand vs. right hand panels).

Figure 40B:
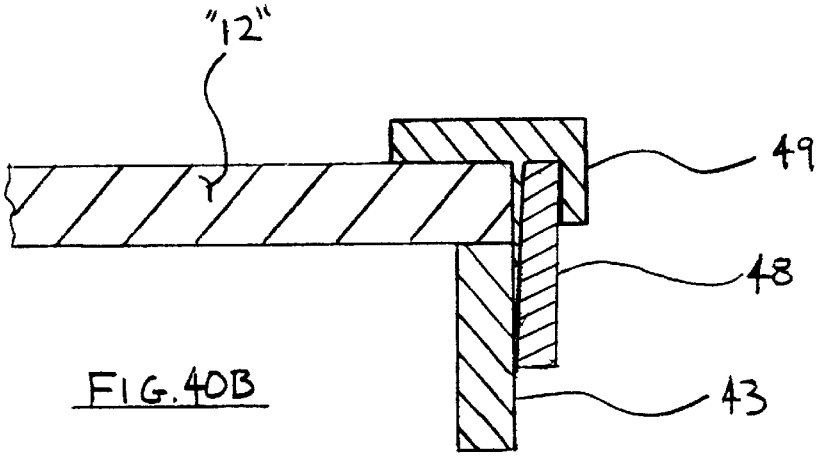
FIG. 40B, Sheet 40—shows an enlarged, sectional assembly view of a typical gable edge of a roof structure wherein the rough-cut edge of a panel is finished with an alternate embodiment of this invention.

Another alternate embodiment is illustrated in FIG. 40B. In the instance of ending a course at a gable, the end panel can be trimmed if needed and the rough edge can be finished in the manner depicted wherein a Gable End Cap 49 is installed over the End Panel 12. A fascia board can then be tucked up under the drip edge of the Gable End Cap as further illustrated in FIG. 40B.

In another embodiment the Ridge Saddle Panel can be made with a series of molded in slots that serve as vents for the roof structure. The appearance of the Ridge Vent Saddle Panel would be virtually identical on the upper, exposed surface.

As described earlier herein and further illustrated in FIGS.1A, 1B and 2, the exposed surface 1 of the roof panels can be made to replicate conventional roofing media in appearance such as Spanish Tile FIG. 1A or Cedar Shakes FIG. 1B. For simplicity sake, the majority of the Figures depicting the plurality of panels are shown with a smooth exposed surface 1.

Referring now to FIGS. 4A–4C, a standard RH Field Panel is shown. Depicted as hidden lines 23 beneath surface 1 are a plurality of reinforcing ribs. These ribs serve to strengthen and stiffen the panels and provide significant mass through which an installer can cut the panel to a shorter length while leaving a continuous surface for the end wall. The open area between the rib walls also serves as a material saver or "core-out" area that is desirable in maintaining a nominal wall thickness of the finished product. Each of the panels is "cored-out" in this manner. This feature is important in controlling "sink" in the finished product as well as optimizing the molding process. Sink occurs in molded parts where non-uniform wall thickness' exist because the thicker wall section, which has more mass, cools slower and shrinks more than a thinner section thereby creating a sink or void on the surface of the finished product.

The coverage area of the exposed surface of a full size standard Field Panel as depicted in FIG. 1A is 48" horizontal length by 24" or 32" depending on the standard centerline distance of the trusses or rafters. Ten standard Field Panels (48"×32") would be required to cover a full square (100 sq.ft.) and would weigh less than 400 pounds. This is considerably less than any of the more commonly used roofing products, which can exceed 1000 pounds per square.

Figure 3:
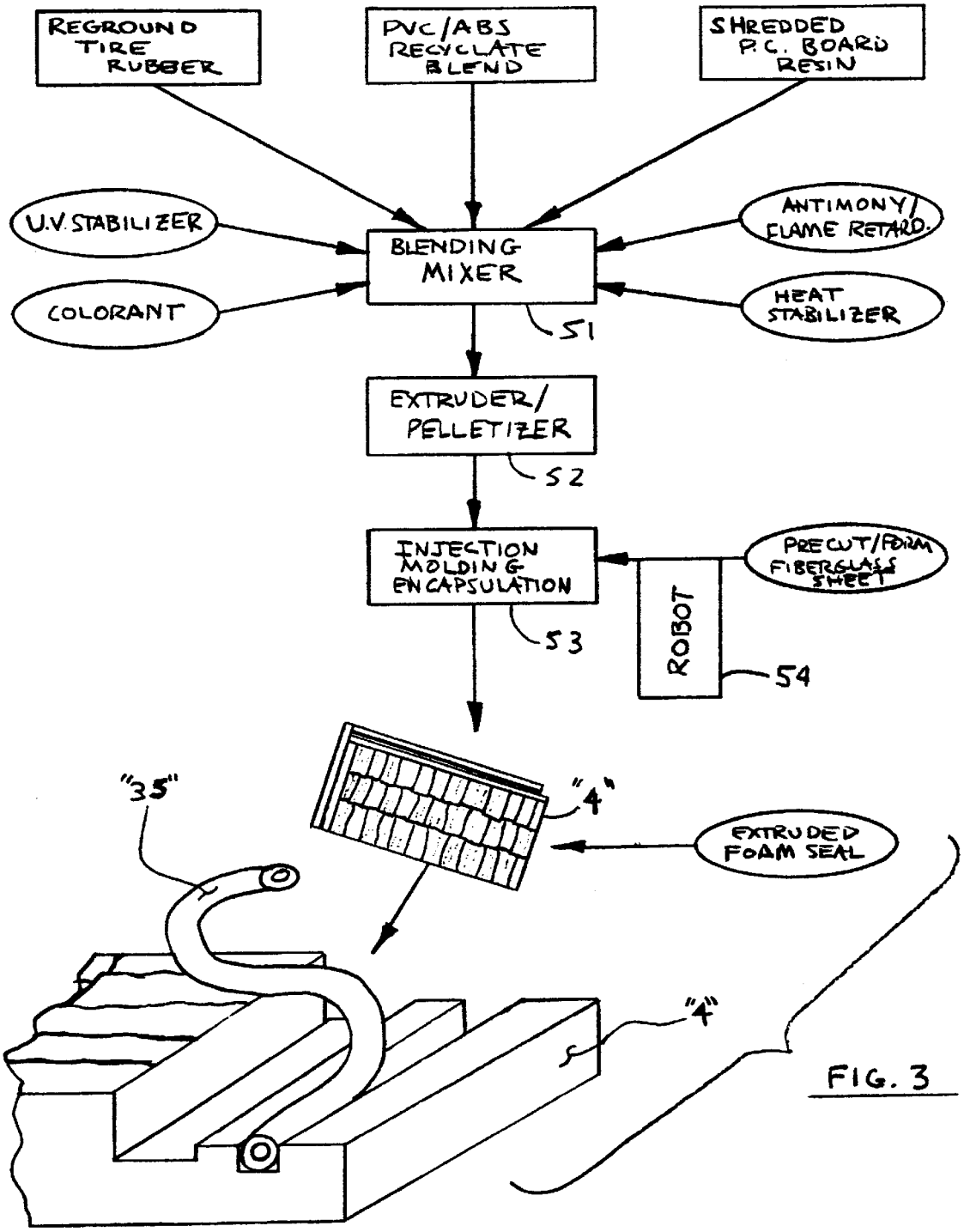
FIG. 3, Sheet 3—shows a schematic of the process for manufacturing the plurality of panels of the present invention.

A method of continuous production is depicted in FIG. 3. This process begins by blending together the compound ingredients based on a rigid PVC (Polyvinyl Chloride)/ABS (Acrylonitrile Butadiene Styrene blend of approximately 50%/20% respectively by weight. The PVC is a blend of at least 50:50 virgin resin such as CONDEA-Vista Suprel 9300 and recycled rigid molding or extrusion grade material (Geon 68929) such as utilized in vinyl windows, doors and pipe fittings. The ABS is 100% recycled molding grade resin which is readily available worldwide. Clean reground tire rubber in the 30/50 mesh size range is added to the blend at approximately 5% by weight. Up to 0.250" long shredded printed circuit board laminate resin is blended in to the mix at the rate of approximately 10% by weight. The final 15% of the blend is made up of a flame retardant such as Antimony Trioxide (Laurel Industries), heat and UV stabilizers and a powder type colorant (Peacock Colors). The volume of colorant added to the mixture will vary depending on the inherent colors of the recycled PVC and ABS.

All of these components are blended together in a conventional gravimetric mixer for solids such as built by Novatec, Inc. and extruded into pellet form using a vented type extruder such as built by Davis-Standard Corp. Venting is critical to allow volatiles to escape.

The extruding process is perhaps the most critical step of the manufacturing process because any excessive variation in melt temperatures, feed rate or inadequate venting will result in a compound that exhibits inferior thermal and mechanical characteristics. For optimum results, the extruder heat settings should be 280 degrees F. at the rear zone and 300 degrees F. at the middle and front zones with a feed rate of 400–500 pounds/hour. The melted materials are forced through a die face at the end of the extruder barrel. The die face is submerged in water and is comprised of a plurality of circular holes through which the material passes. As the material exits the die face it is contacted by the water, which has an immediate cooling and solidifying effect on the material. A series of rotating blades which are in direct contact with the smooth surface of the die plate, shear the material into random length pellets of 0.090–125" long. The pellets subsequently emerge from the water and pass under a series of heat sources that evaporate the residual moisture.

The extruded compound, if used within 2–3 days will require no additional processing before molding. If a longer period of time between extruding and molding is anticipated, the compound should be stored in an airtight container. The stored material should be dried in a dehumidifying drier such as built by AEC/Whitlock prior to molding at a temperature of 250 degrees F. for 2–3 hours. If material was not stored in an airtight container it should be dried at 300 degrees F. for 3 hours.

The compound is introduced to a horizontal clamp injection-molding machine such as built by Cincinnati Milacron. The compound passes through a heated barrel, remelted and forced under high pressure, into an injection mold. The mold opens and closes along a horizontal axis and when fully opened, the molded panel can be manually removed by an operator or automatically by an electromechanical robot such as built by Sterling, Inc. After the molded panel has been removed and the mold is still in the open position, a single fiberglass mesh sheet is positioned in the mold such that it is fully supported and retained through out the mold closing process. Upon full closure of the mold, the melted plastic compound is injected into the mold fully encapsulating the fiberglass mesh sheet. The specific apparatus used for removal of the molded panel and for loading the fiberglass mesh sheet is custom designed (Danik Group, Inc.) for the application.

Conclusion, Ramification and Scope

From the afore detailed description it should be apparent that the invention described herein represents a cost effective, easily installed and durable alternative to conventional and more costly roof construction methodologies. It should be further apparent that the process described herein to manufacture said invention is sufficiently specified to allow maximum flexibility in producing panels of various configurations, appearances and colors that provide a weather tight, fire retardant and structurally rigid roof panel system.

Furthermore, the roof panel system has the additional advantages in that

- It is constructed from the trusses or rafters out;
- It requires no rigid sheathing or moisture barrier (felt paper);
- It allows the architect flexibility in design with no compromise in durability;
- It provides for a method of roof construction that not only generates no job site waste but diverts useful materials from the waste stream that might otherwise be landfilled; and
- It can be manufactured with existing, proven and efficient equipment.

While the invention has been set forth herein with a certain degree of particularity, it is manifest that changes may be made in the details of construction, the arrangement of the components and the manufacturing process without departing from the spirit and scope of this disclosure.

Thus the scope of the invention should be determined by the appended claims and their legal equivalents, rather than by the examples given.

I claim:

1. A rigid roof panel system that includes a plurality of overlapping, underlapping and interlocking, application specific panels installed on roof structures using trusses or rafters having a minimum roof pitch of 3:12 wherein each panel is affixed directly to a top edge of said truss or rafter with no conventional plywood or other rigid sheathing and no moisture barrier required and employs a series of horizontally, vertically and diagonally arrayed water channels that perform their function of shedding water beneath the exposed or visible top surface of the overlapping panels while also providing a method of positively positioning each panel with adjacent panels of the same course and adjacent panels of the previous and following courses with said panels employing an integral seal along a horizontal headlap and a diagonal edge-lap for each overlapping and underlapping seam, and each panel being securely fastened to the trusses or rafters of the roof structure by means of self sealing, threaded fasteners that are tightened to compress the integral seals and are covered by a composite plug whose design features an exposed surface identical in texture and color to the panel in which it has been installed, whereby said panels are injection molded with a thermoplastic compound comprised in part of recycled plastics, tire rubber and printed circuit board resin wherein said thermoplastic resins, additives and rubber unite in a homogenous blend hardening around and binding to the integral printed circuit board resin, and in which a fiberglass mesh sheet is encapsulated in said compound during the injection molding process providing structural rigidity and the ability to withstand the intermittent flame and fire brand tests required to achieve a UL Class A fire rating as well as wind uplift tests as specified by UL125.

* * * * *